US006428260B1

(12) United States Patent
Parker

(10) Patent No.: US 6,428,260 B1
(45) Date of Patent: Aug. 6, 2002

(54) BOOKBINDING SYSTEM AND METHOD

(75) Inventor: Kevin P. Parker, Berkeley, CA (US)

(73) Assignee: Powis Parker Inc., Berkeley, CA (US)

( * ) Notice: Subject to any disclaimer, the term of this patent is extended or adjusted under 35 U.S.C. 154(b) by 0 days.

(21) Appl. No.: 09/575,291

(22) Filed: May 19, 2000

Related U.S. Application Data

(63) Continuation-in-part of application No. 09/270,247, filed on Mar. 15, 1999, now Pat. No. 6,155,763, which is a continuation-in-part of application No. 09/146,994, filed on Sep. 4, 1998, now abandoned.

(51) Int. Cl.[7] ..... B42D 3/04; B42C 3/00

(52) U.S. Cl. ..... 412/6; 156/230; 156/249; 281/15.1; 281/21.1; 412/1; 412/4; 412/5; 412/8; 412/19; 412/21; 412/900; 412/902; 428/42.3

(58) Field of Search ..... 412/4, 900, 5, 412/1, 6, 902, 8, 19, 21; 428/42.3; 281/21.1, 15.1; 156/230, 249

(56) References Cited

U.S. PATENT DOCUMENTS

| | | | | | |
|---|---|---|---|---|---|
| 3,572,767 | A | | 3/1971 | Learned et al. | 281/34 |
| 3,847,718 | A | * | 11/1974 | Watson | 281/21 |
| 4,420,282 | A | * | 12/1983 | Axelrod | 412/4 |
| 4,496,617 | A | | 1/1985 | Parker | 428/55 |
| 4,627,219 | A | * | 12/1986 | Omori | 53/399 |
| 4,800,110 | A | | 1/1989 | DuCorday | 428/43 |
| 5,052,873 | A | * | 10/1991 | Parker et al. | 412/8 |
| 5,452,920 | A | * | 9/1995 | Parker | 281/21.1 |
| 5,613,711 | A | * | 3/1997 | Parker | 281/21.1 |
| 5,779,423 | A | | 7/1998 | Bermingham | 412/4 |
| 5,829,938 | A | * | 11/1998 | Hartwig et al. | 412/8 |
| 6,017,178 | A | * | 1/2000 | Rathert | 412/8 |
| 6,155,763 | A | * | 12/2000 | Parker et al. | 412/6 |

* cited by examiner

*Primary Examiner*—A. L. Wellington
*Assistant Examiner*—Mark T. Henderson
(74) *Attorney, Agent, or Firm*—Girard & Equitz LLP

(57) ABSTRACT

A bookbinding system and method of binding books including a cover/spine assembly having a relatively rigid cover section with a length and width at least as great as that of the stack of sheets to be bound and a spine section having a width greater than the height of the stack. The cover/spine assembly and the spine section are secured together along the length of the cover section so that the spine section can be folded along a first edge with respect to the cover/spine assembly. A heat activated matrix is disposed on the spine section including a central adhesive band and an outer band disposed between the central adhesive band and a second edge of the spine section. Binding is carried out by placing the stack over the cover section and folding the spine section over the edge of the stack. Preferably a second relatively rigid cover section is placed on top of the stack so that the outer adhesive band on the spine section will extend over second cover section. The central adhesive band is a low viscosity adhesive which, when activated, bonds the sheets of the stack to the spine section to form the spine of the bound book. The outer adhesive band, when activated, bonds the second cover to the spine section thereby forming a hardcover book having the feel and appearance of a book bound using conventional techniques.

11 Claims, 22 Drawing Sheets

BOOKBINDING SYSTEM AND METHOD

CROSS-REFERENCE TO RELATED APPLICATIONS

The present application is a Continuation-In-Part Application of application Ser. No. 09/270,247 filed on Mar. 15, 1999, now U.S. Pat. No. 6,155,763 which is a Continuation-In-Part Application of application Ser. No. 09/146,994 filed on Sep. 4, 1998, now abandoned.

BACKGROUND OF THE INVENTION

1. Field of the Invention

The present invention relates generally to the field of bookbinding and, in particular, to a bookbinding system which utilizing a substrate having an adhesive coating, with the substrate forming the spine and front cover of the book.

2. Description of Related Art

Binding systems using a binding strip are well known as exemplified by U.S. Pat. No. 4,496,617. One disadvantage of the binding strip system is that specialized equipment is needed to print information on the strip. Other types of binding systems incorporate a wrap around cover which includes what will be the front cover, the back cover and the spine of the bound book. Such a binding system is disclosed in U.S. Pat. No. 4,289,330. One disadvantage of the wrap around cover binding system is that different thicknesses of stacks of pages to be bound require different sizes of wrap around covers.

In addition, conventional binding systems capable of use with relatively inexpensive using desktop binding machines produce bound books having soft covers. In some instances, there is a need for a low cost binding system that can produce a bound book having hard covers.

The present invention overcomes the above-noted shortcomings of the prior art. The binding system in accordance with the one embodiment of the present invention includes front, rear and a spine sections, all of which can be printed using a conventional desk top ink jet. Further, a single size embodiment of the subject binding system can accommodate a relatively wide range of book thicknesses. Further, a second embodiment of the present invention permits a hardcover book to be produced using conventional desktop bookbinding machines. These and other advantages of the present invention will become apparent to those skilled in the art upon a reading of the following Detailed Description of the Invention together with the drawings.

SUMMARY OF THE INVENTION

A bookbinding system and method of binding a stack of sheets is disclosed. The system includes a cover/spine assembly comprising a relatively rigid cover section and a spine section. The cover section has a width and length at least as great as the length and width of the stack to bound. The spine section has a length that corresponds to the length of the first cover section and a width which is greater than the height of the stack.

A first edge of the spine section is secured to a first edge of the cover section along the length of the cover section so that the spine section can be folded with respect to the cover section. An adhesive matrix is disposed on the spine section, which includes a central adhesive band extending along the length of the spine section, with the central adhesive band being a heat-activated, relatively low viscosity adhesive. The matrix further includes an outer adhesive band extending along the length of the spine section intermediate the central band and a second edge of the spine section, opposite the first edge.

A stack is bound by placing the stack over the cover section and folding the spine section over the edge of the stack. Preferably, a second relatively rigid cover section is placed over the stack, with a portion of the folded spine section being positioned over the second cover section. The assembly is placed in a conventional desk top binding machine which operates to activate the central adhesive so that the edge of the stack will be able to absorb the low viscosity adhesive and to activate the outer adhesive band so that the spine section will be bonded to the second cover section. A bound book will result simulating the feel and appearance of a hardcover book bound using conventional techniques.

DETAILED DESCRIPTION OF THE INVENTION

Figure 1:
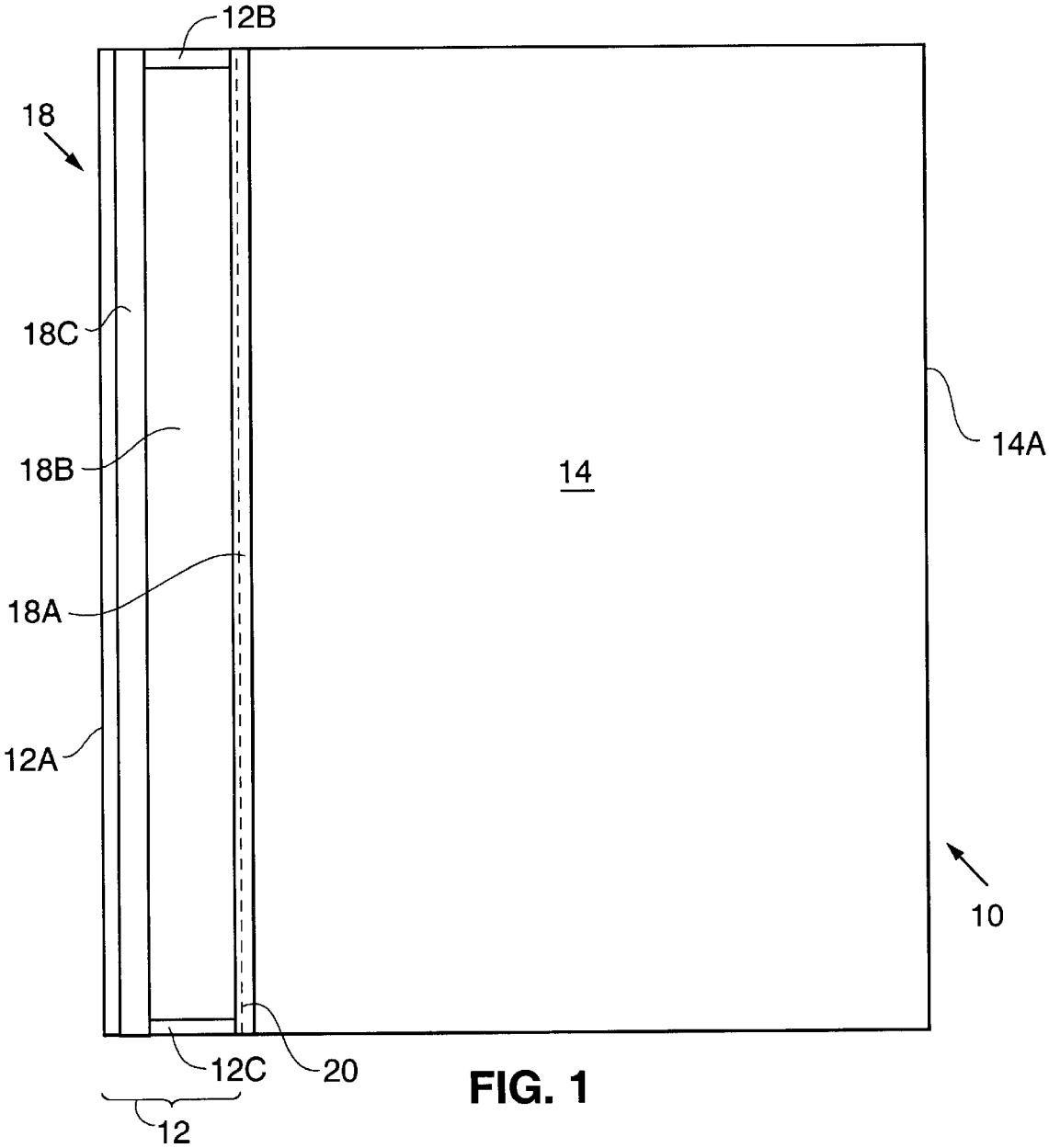
FIG. 1 is a plan view of the cover/spine assembly of a first embodiment of the subject binding system prior to binding.
Figure 2:
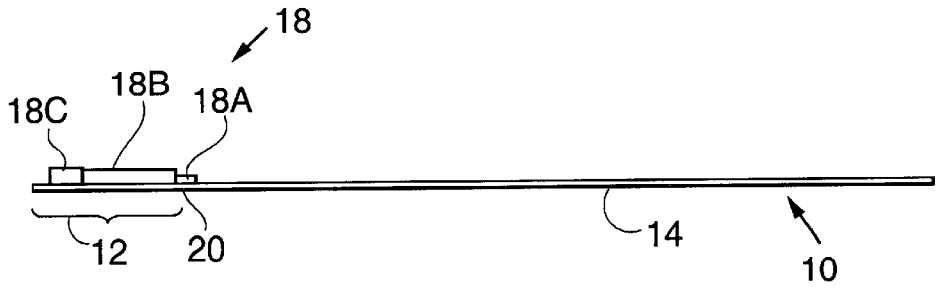
FIG. 2 is a side elevational view of the cover/spine assembly showing some of the details of the adhesive matrix.

Referring to the drawings, FIG. 1 is a plan view of the interior of a cover/spine assembly, generally designated by the numeral 10, of a first embodiment bookbinding system used to bind a stack of sheets to form a bound book. Assembly 10 includes a spine section 12 and an integral cover section 14 formed from a single sheet of heavy weight paper stock. A crease 20 (not depicted) is formed in the sheet of paper stock thereby dividing the stock into the spine and cover sections 12 and 14, respectively. As is well known, crease 20 can be formed by passing paper stock between a pair of rollers, with one of the rollers having a protrusion which extends into a groove formed in the second roller. The roller with the protrusion passes over the underside of the stock as viewed from FIG. 1 so that the crease appears as an indentation on the exterior side of the assembly 10. Cover section 14 typically has the same outer dimensions as the sheets to be bound or is slightly larger.

Figure 4:
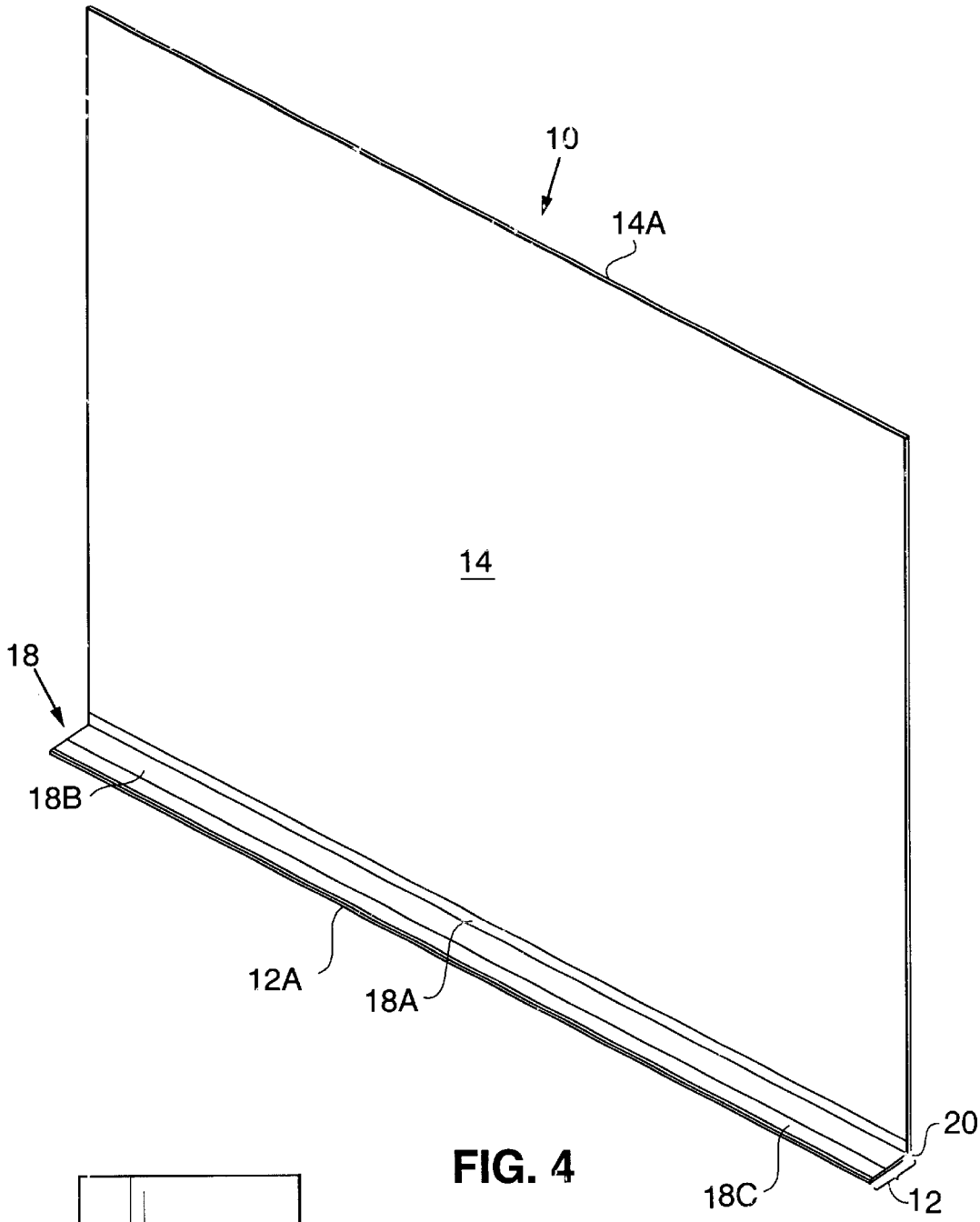
FIG. 4 is a perspective view of the cover/spine assembly with the first fold in the assembly being formed.

Referring also to FIG. 4, the cover/spine assembly 10 includes an adhesive matrix 18 formed on the interior side of paper stock. Matrix 18 includes an inner adhesive band 18A which extends along the full length of crease 20 from the top to the bottom of the cover spine assembly 10. The adhesive properties of inner adhesive band 18A can be the same as those of the central adhesive band, which will be described.

Inner band 18A is typically ⅛ inch wide and can be very thin, such as 0.005 inches thick. Although not shown in the drawings, it is preferred that a thin layer, typically 0.003 inches, of high viscosity adhesive be applied to the spine section 12 prior to application of the remainder of the adhesive matrix. An adhesive sold under the designation HB HL-1777 by the H. B. Fuller Company of St Paul, Mn. has been found suitable for this purpose. The thin, high viscosity layer functions to act as a barrier which eliminates the tendency of the low viscosity adhesive of band 18B to pass through the spine section 12 and thereby becoming visible on the exterior of the bound book. The barrier layer also has been found to prevent all of the low viscosity adhesive of band 18B from being drawn up between the sheets thereby ensuring that a portion of the adhesive remains to reliably secure the spine section 12 to the bottom edge of the stack 22.

Central adhesive band 18B, which is the primary adhesive for binding the sheets of stack 22, has an inner edge which extends up to and along crease 20. This is important since, as will be explained, the central adhesive band 18B must be able to contact the edges of all of the sheets to be bound, including sheets located near crease 20. Band 18B is a low viscosity, heat-activated adhesive. An adhesive made by National Starch & Chemical Company of Bridgewater, N.J. under the designation Cool-Bind 34-1301 has been found suitable for inner band 18A. Central adhesive band 18B is preferably approximately 0.015 inches thick and, as will be described later in greater detail, is at least as wide as the thickness of the stack of sheets to be bound. As can best be seen in FIG. 1, central band 18B preferably extends over slightly less than the full length of the spine section 12 so that gaps 12B and 12C in the adhesive are present at both ends of the band.

Outer band 18C is positioned adjacent the central adhesive band 18B and is preferably of approximately the same thickness as inner band. The outer band 18C is also preferably displaced from the edge 12A of the spine section 12 a fixed distance so that, after the binding sequence, the adhesive will be displaced to edge 12A but no further. The outer edge of adhesive 18C should be no further than 0.5 inches from the edge 12A of the spine section, and preferably less, as previously noted. In addition, it is preferred that the width of the spine section 12 be less than ¼ the width of the cover section 14. An adhesive made by HB Fuller Company of St. Paul, Minn. and marketed under the designation HL-1777 has been found suitable for outer band 18C.

Figure 3:
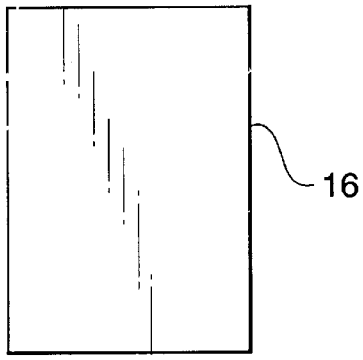
FIG. 3 is a plan view of the rear cover piece of the first embodiment of the subject binding system prior to binding.

FIG. 3 illustrates the rear cover piece 16 which forms the back of the bound book and which is preferably made of the same heavy weight paper stock used in the cover/spine assembly 10. Rear cover piece 16 has the same outer dimensions as the sheets to be bound and as that of the cover section 14 of the cover/spine assembly 10.

Having described the first embodiment cover/spine assembly 10, the manner in which the assembly can be used to bind a stack of sheets will now be described. One advantage of the subject invention is that the actual binding process can be carried out using an existing binding machine of the type which utilizes binder strips. Such a machine is described in U.S. Pat. No. 5,052,873 entitled APPARATUS AND METHOD OF BINDING A BOOK, the contents of which are fully incorporated herein by reference. The binding machine includes apparatus for loading and otherwise manipulating a binder strip which is not needed and which can be temporarily disabled by way of a minor modification. Alternatively, the binder strip sensing mechanism can be triggered by momentarily inserting a binder strip into the strip input of the machine and then removing the strip so the strip will not be fed into the machine. The manner in which a binding machine could be implemented which is dedicated to binding sheets using the subject cover/spine assembly 10 will be readily apparent from the following description.

The binding sequence is initiated by measuring the stack of sheets to be bound and selecting a cover/spine assembly 10 of appropriate dimensions. The different assemblies have the same dimensions except for the width of the spine section 12 which, as previously noted, is defined as that portion of the assembly intermediate crease 20 and edge 12A. As will be explained in greater detail, it is anticipated that a total of only four different dimensioned assemblies 10 need be kept in stock in order to have the capability of binding stacks having a wide range of widths. This is significantly fewer than required in conventional wrap around covers such. as described in the previously-noted U.S. Pat. No. 4,289,330. One such prior art product is available. in 1/16 inch increments so that a total of twenty four different cover sizes are needed to bind stacks ranging in thickness-from 0 to 1.5 inches.

Figure 5:
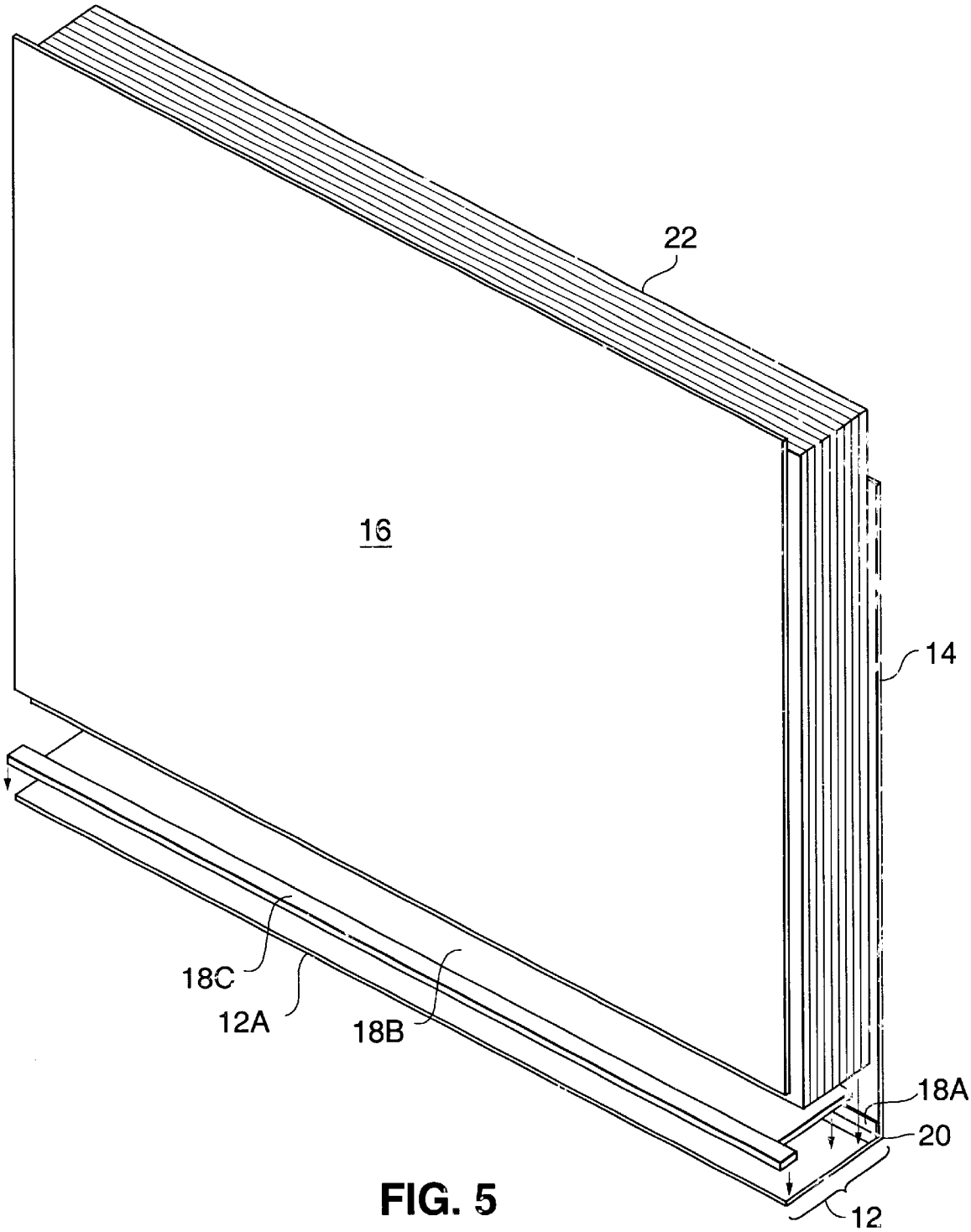
FIG. 5 is a perspective exploded view of the cover/spine assembly and a stack of sheets about to be bound in accordance with the first embodiment of the present invention.
Figure 6:
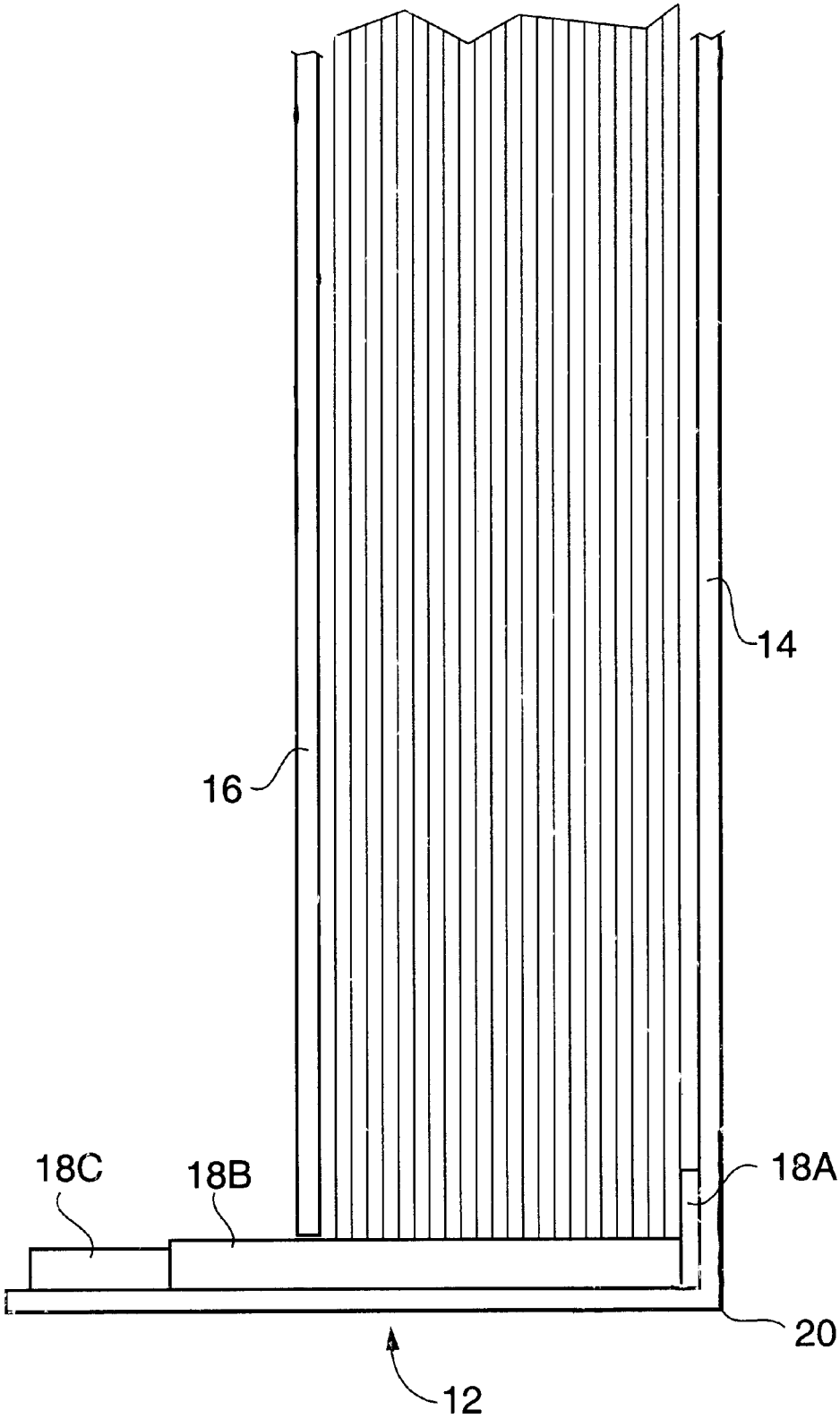
FIG. 6 is a schematic diagram of an end view of a stack after the first fold has been formed and prior to formation of the second fold.

Once the appropriate dimensioned cover/spine assembly 10 has been selected, the assembly in manually folded along crease 20 so that the spine section 12 is approximately at right angles with respect to the cover section as shown in FIG. 4. The stack of sheets 22 are then assembled together with the rear cover piece 16. The stack 22 and rear cover piece 16 are then manually positioned on the spine section 12 as shown in FIGS. 5 and 6. It is preferred that the sheets 22 and cover piece be placed in a conventional jogging machine prior to placement on the cover/spine assembly 10 so that the edges of each individual sheet of the stack 22 will contact the central adhesive band 18B.

Figure 7A:
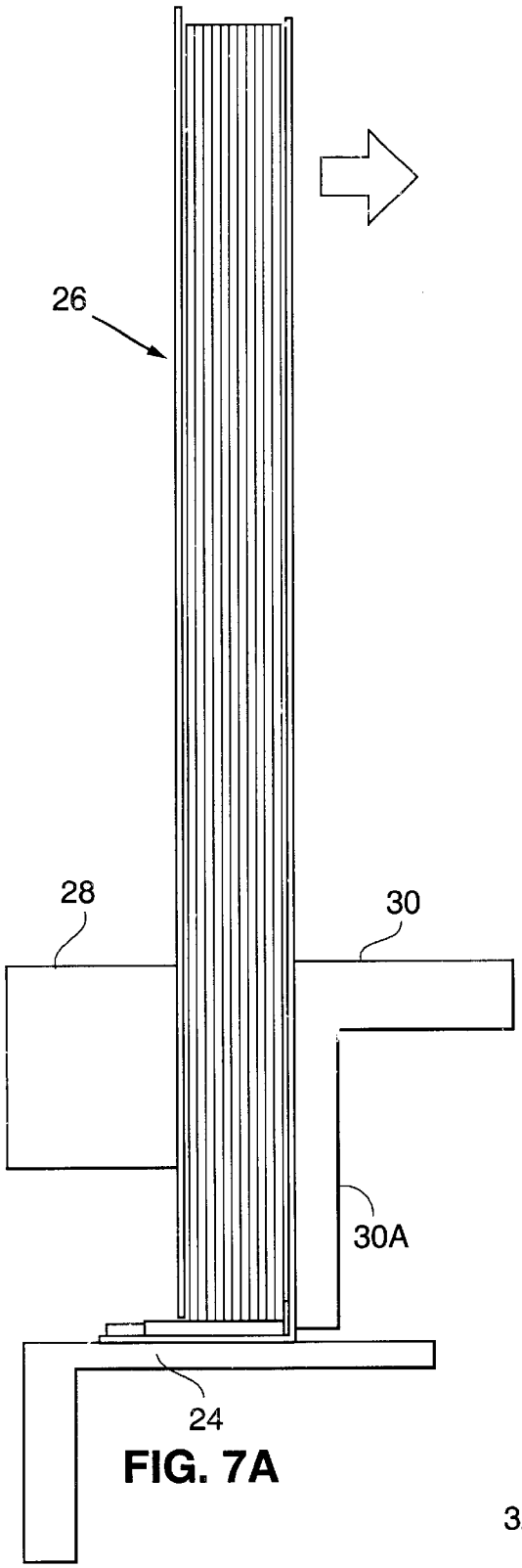
FIG. 7A shows a stack being bound in accordance with the first embodiment of the present invention, with the stack being positioned on a cold platen.

The stack 22, rear cover section 16 and assembly 10, collectively referred to as book 26, are then manually positioned on a cold platen 24 of a binding machine as shown in FIG. 7A. The machine is then actuated thereby causing the book to be gripped between a first support 28 and a second support 30. Second support 30 includes a lower section 30A which is positioned to provide support near the spine of the book 26.

Figure 7B:
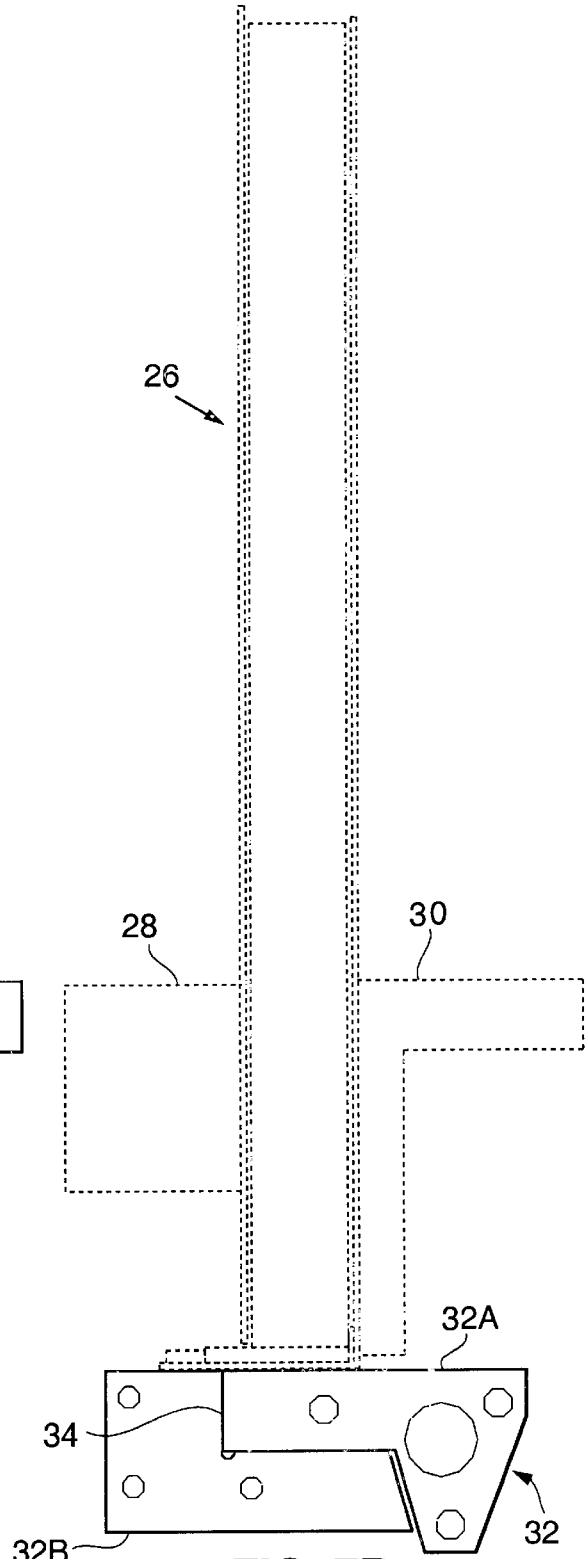
FIG. 7B shows the stack being bound in accordance with the first embodiment of the present invention, with the stack being transferred from the position of FIG. 7A to a position on a heated platen.
Figures 8, 9:
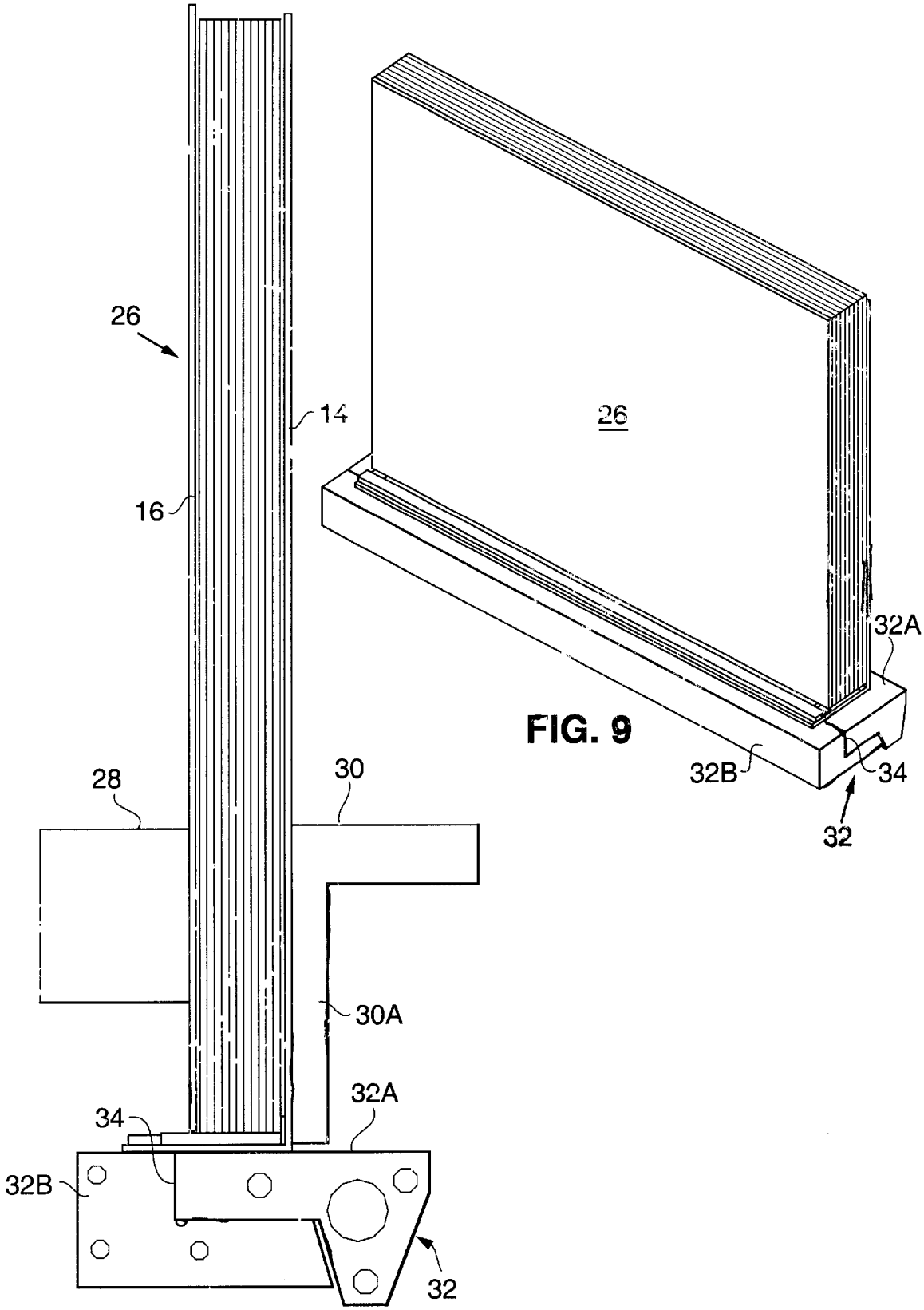
FIG. 8 is similar to FIG. 7B and shows the stack being bound resting on the heated platen.
FIG. 9 is a perspective view of the stack resting on the heated platen prior to formation of the second fold in the cover/spine assembly.

Next, book 26 is transferred from the cold platen 24 to a heated platen 32 as shown in FIG. 7B. This is accomplished by moving supports 28 and 30 together so that book 26 remains gripped between the two supports. As can be seen in FIGS. 8 and 9, book 26 is positioned on the heated platen 32 so that the rear cover piece 16 of the book is aligned with the interface 34 between a fixed section 32A of the platen and a rotating section 32B of the platen.

Typically, the fixed section 32A is electrically heated to a temperature of approximately 415 to 425° F., with the rotating section being heated by way of conduction by. the fixed section.

Book 26 will remain on platen 32 for approximately 10 to 15 seconds so that the central adhesive 18B will have adequate time to become molten. A moderate upward pressure is applied by platen 32 to book 26 so that the molten, low viscosity, central adhesive 18B will contact the edge of each sheet of stack 22. In addition, a small quantity of the adhesive will be drawn up between the individual pages by virtue of capillary action thereby insuring that each page will be adequately bound. The thin inner adhesive band 18A will also be heated by way of conduction though central adhesive 18B and nearby structure so that the adhesive will also be activated.

Figures 10, 11:
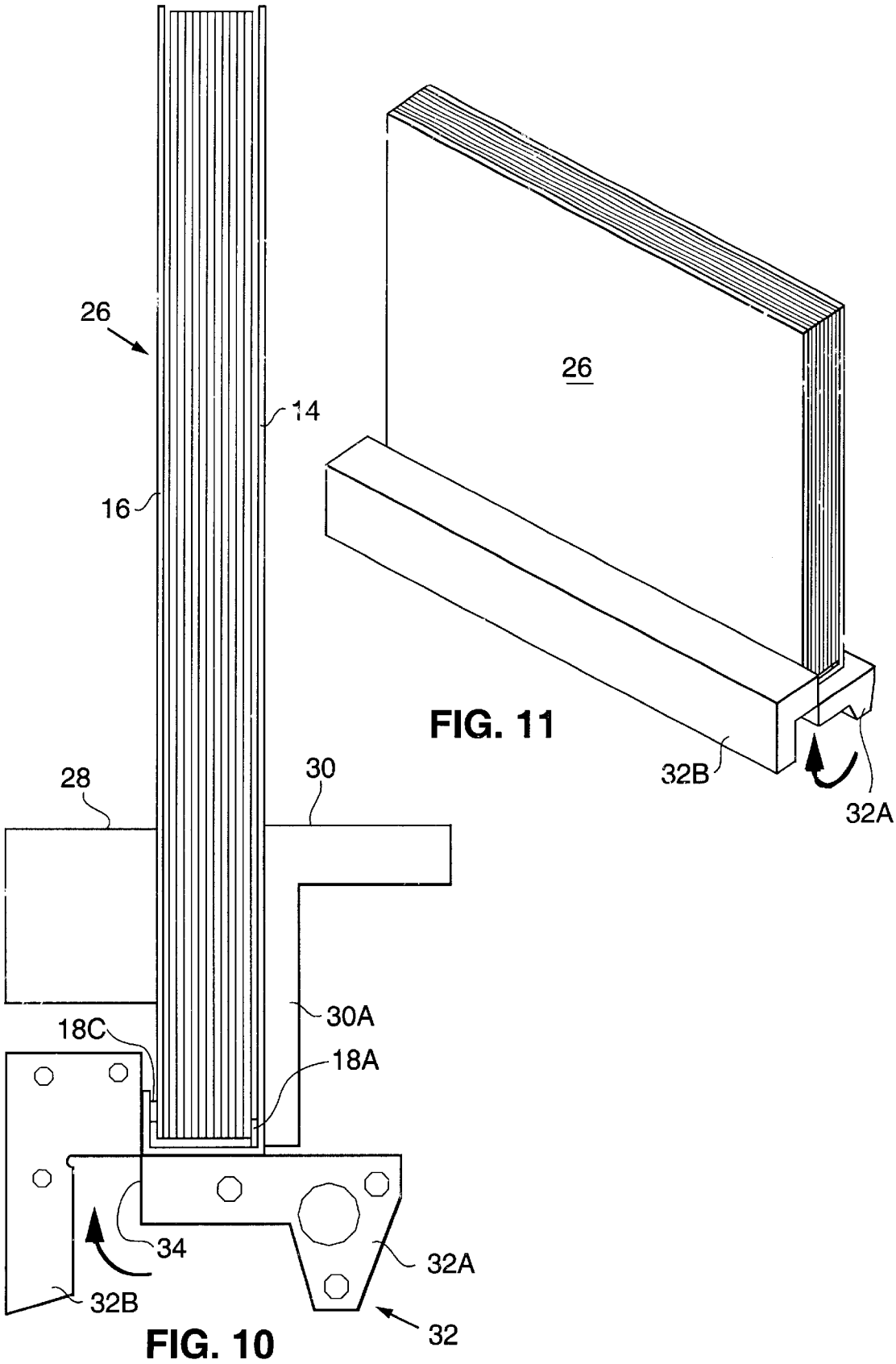
FIG. 10 shows the stack being bound resting on the heated platen, with the pivoting section of the heated platen being rotated so as to form the second fold in the cover/spine assembly.
FIG. 11 is a perspective view of the cover/spine assembly showing the stack being bound resting on the heated platen with the pivoting section rotated so as to form the second fold.

As shown in FIGS. 10 and 11, rotating section 32B of the heated platen is then rotated 90°. This will cause a portion of the spine section 12 to be folded around the lower edge of the stack so that the outer adhesive band will be forced against rear cover 16. The excess central adhesive 18B, the portion of the adhesive not contacting the edge of the stack, is wrapped around the lower portion of the rear cover piece 16. The rotating section 32B of the platen will cause heat and pressure to be applied to that part of the spine section 18 opposite outer adhesive band 18C, with the lower portion 30A of the second support 30 on the opposite side also operating to apply pressure to the book 26, including the heated inner adhesive band 18A.

Figure 12:
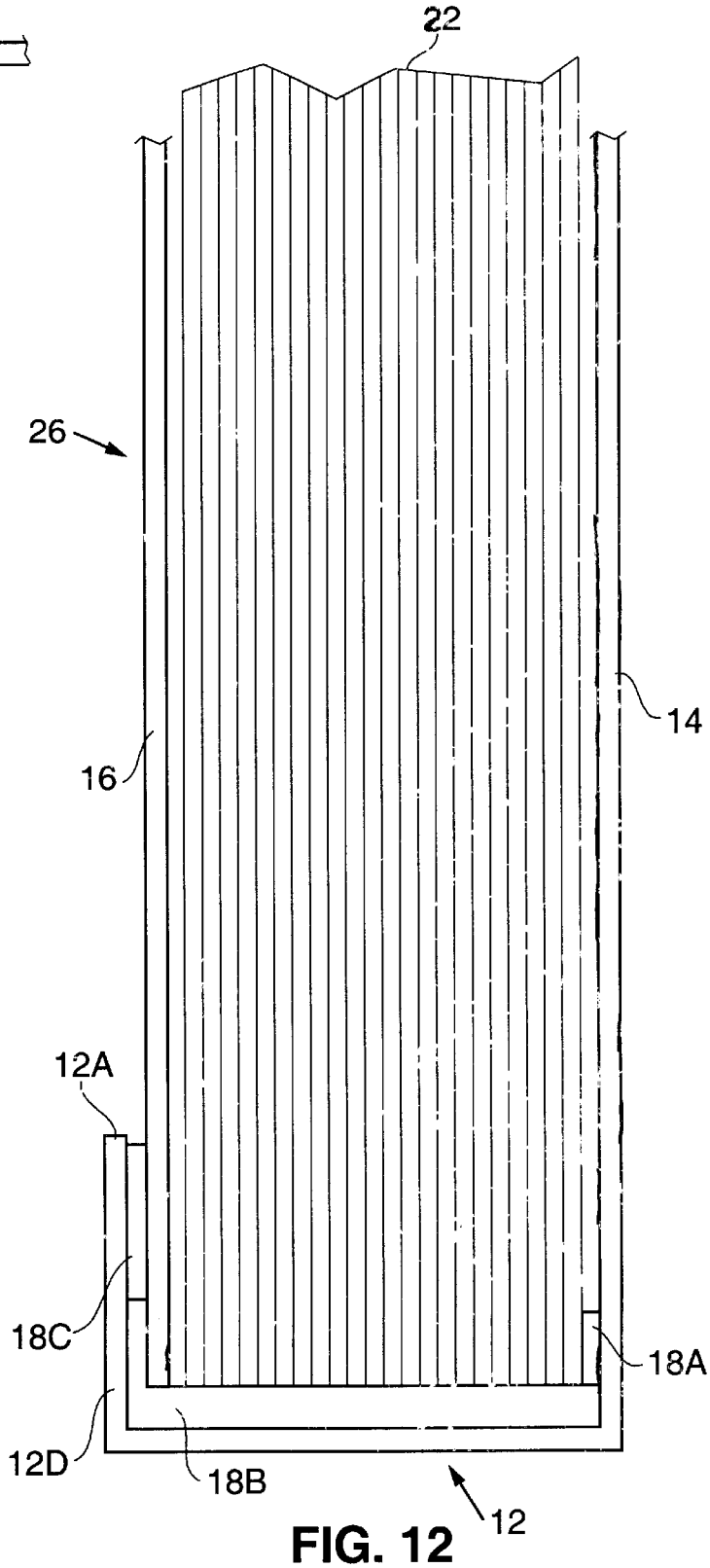
FIG. 12 shows the edge of the book at the end of the binding sequence.

As can best be seen in FIG. 12 which illustrates the final bound book 26, the applied heat and pressure will cause the outer adhesive band 18C to form a bond between the spine section 12 near edge 12A and the rear cover piece 16. Although the FIG. 12 structure (like FIG. 6) is not to scale, with certain dimensions being exaggerated to show certain details more clearly, it can be seen that outer adhesive band 18C is flattened and displaced so that the band extends close to the edge 12A of the spine section 12. Further, although not illustrated in FIG. 12, the thickness of band 18C is actually reduced to the point that the edge 12A actually contacts the rear cover piece 16 thereby forming an relatively continuous surface between the spine section and the rear cover piece. The low viscosity central adhesive band 18C will have flowed up between the individual sheets so that each sheet is secured upon cooling. The voids formed by gaps 12B and 12C in the central adhesive band 18C will receive some of the molten adhesive thereby reducing the likelihood that excess molten adhesive will flow out from under the spine section 12 so as to detract from the appearance of the bound book.

Figure 13:
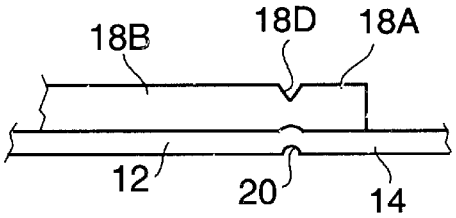
FIG. 13 shows an alternative construction of the adhesive matrix of the first embodiment subject cover/spine assembly.

As previously noted, the edge of central adhesive 18B should be positioned over crease 20 so that the adhesive will contact all of the sheets of the stack 22, including the sheets closest to the cover section 14. However, since the cover/spine assembly will typically be manually folded along the crease, there will always be some inaccuracy in the location of the actual fold line with respect to the crease. An inaccuracy on the order of one or two thicknesses of the sheets being bound is sufficient to prevent each of the sheets from being captured by the central adhesive 18B. Inner adhesive band 18A is present to ensure that the sheets near the cover section 14 will be secured regardless of such inaccuracy. Adhesive band 18A is made thin to facilitate folding along the crease. However, to simplify the manufacturing process, it would be possible to make the central adhesive band 18B and the inner adhesive band 18A the same thickness. As can be seen in FIG. 13, the thickness of the. central adhesive band 18B and the inner adhesive band 18A is the same. The two bands are separated by a notch or groove 18D formed in the adhesive over the location of the crease 20 which extends along the length of the inner adhesive band. Thus, the assembly can be more readily folded at the crease 20 by virtue of notch 18D. If there is any misalignment in the fold, inner adhesive band 18A will be present to ensure that the sheets closest to the cover section 14 are secured.

Note that the actual point at which the edge 12A of the spine section contacts the rear cover piece 16 will vary depending upon the width of the stack 22 being bound. A more narrow stack 22 will cause the folded portion 12D of the spine section 12 to extend higher along rear cover section 16. Although one size cover/spine assembly 10 will accommodate a wide range of stack 22 thicknesses, it is important that the folded portion 12D not be so long that the rotating section 32B (FIG. 10) of the heated platen not fully contact the region of the folded portion opposite the outer adhesive band 18C. Thus, for significantly thinner stacks 22, a cover/spine assembly 10 having a more narrow spine section 12 should be selected.

In one existing binding machine, rotating platen section 32B is positioned such that the outer adhesive band 18C must be 5/8 of an inch or less above the lower edge of the book spine (above the fixed platen section 32A) for the rotating platen section to be capable of applying pressure to the folded spine section 12D where outer adhesive band 18C is located. If the outer band 18C is any higher, it cannot be adequately reached by the rotating platen section 32B. Rotating platen 32B extends 5/8 of an inch upwards when in the rotated position shown in FIG. 10. Accordingly, the edge 12A of the spine section should never extend higher along the rear cover 16 than 5/8 of an inch. Table 1 below sets forth the stack 22 widths and the corresponding relative size of cover/assembly 10. It can be seen that for the minimum stack thicknesses of each category, the spine section 12 is sufficiently narrow to ensure that the folded section 12D is no more than ⅝ of an inch.

TABLE 1

| STACK THICKNESS (inches) | ASSEMBLY SIZE (spine section width in inches) |
|---|---|
| 0–3/8 | ⅝ (THIN) |
| ⅜–¾ | 1 (MEDIUM-THIN) |
| ¾–1⅛ | 1⅜ (MEDIUM WIDE) |
| 1⅛–1½ | 1¾ (WIDE) |

An important aspect of the present invention is that it is possible to add printed matter to the cover/spine assembly 10 and to the rear cover piece 16 prior to binding, including titles and cover designs. Printing can be done using a conventional ink jet printer or a laser printer/copier. This produces an attractive bound book similar in appearance to books produced using much more complex and expensive equipment. In the event a laser printer or copier is to be used, the adhesive matrix must added after the printing process has been completed due to the heat,involved in the printing process. This can be done by creating the matrix 18 separate from the cover/spine assembly 10. Once the printing process has been completed, the matrix 18 is manually mounted on the assembly 10 using a pressure sensitive adhesive.

Since laser printers and copiers utilize inks that will be adversely affected by high temperatures, it is important to use heat-activated adhesives in the adhesive matrix 18 which have relatively low activation temperatures. It is also preferable that, subsequent to printing. and prior to binding, the cover/spine assembly 10 be covered with a clear plastic laminating film. The film will help prevent the ink from being smeared or distorted by the elevated temperatures used in the binding process. Ink jet printers do not utilize temperature sensitive inks therefor these precautions are only necessary when laser printers/copiers are to be used.

Figure 14:
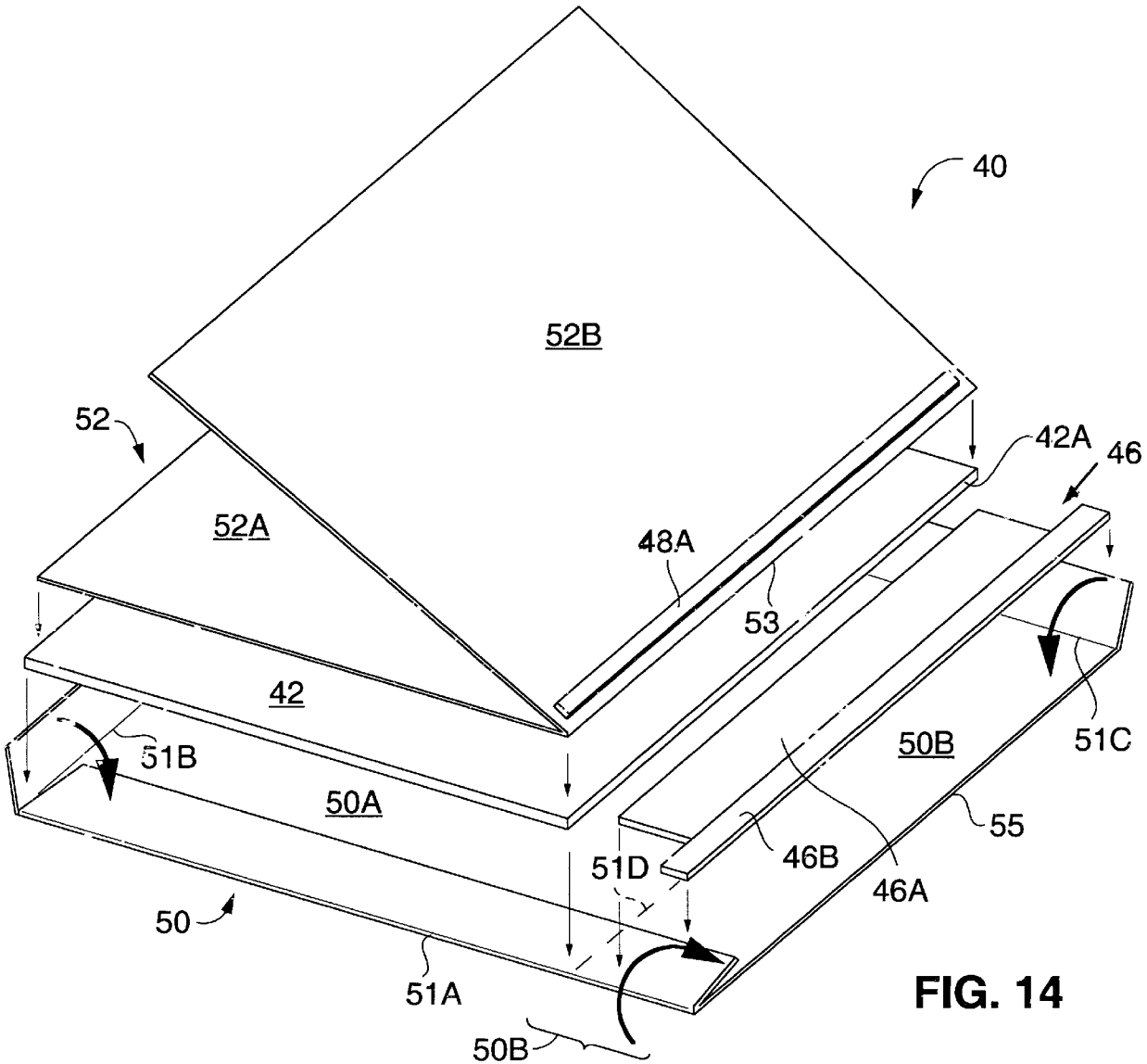
FIG. 14 is an exploded perspective view of the cover/spine assembly of a second embodiment of the present invention.
Figure 15:
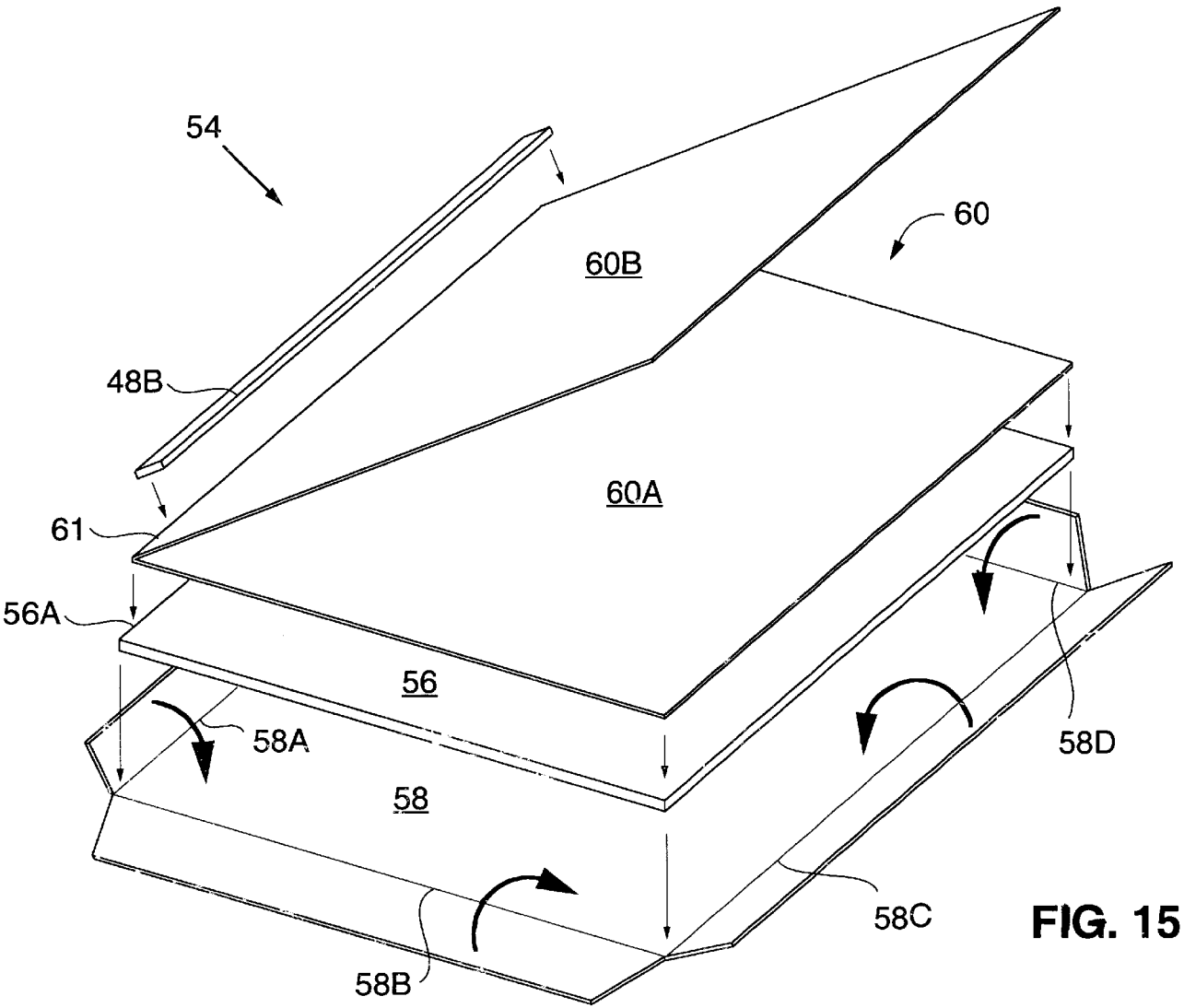
FIG. 15 is an exploded perspective view of the rear cover assembly of the second embodiment of the present invention.
Figure 16:
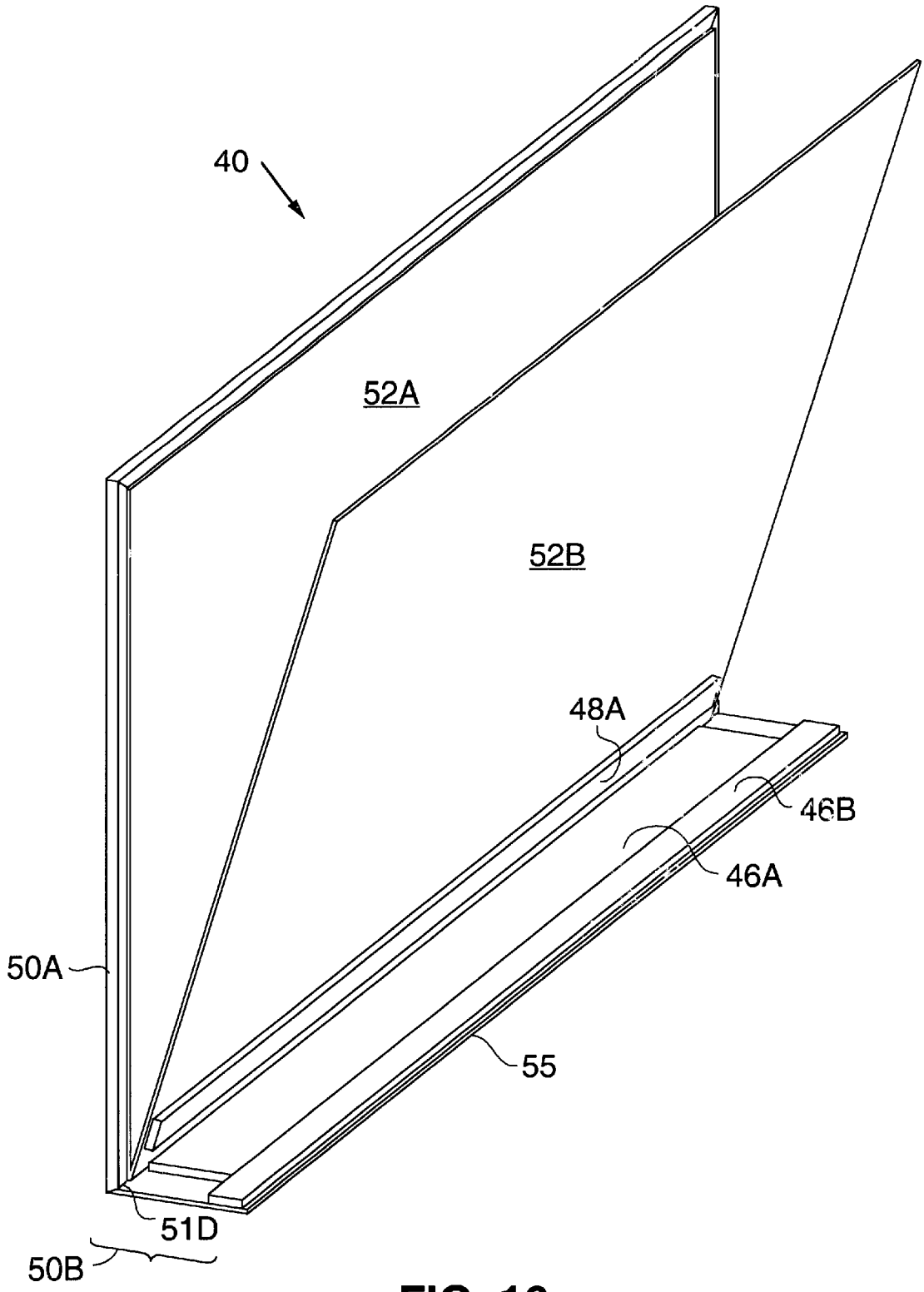
FIG. 16 is a perspective view of the cover/spine assembly of the second embodiment of the present invention.

FIGS. 14 through 17 depict a second embodiment bookbinding system which produces hardcover bound books. Referring to FIGS. 14 and 16, a spine/cover assembly, generally designated by the numeral 40, is shown in an exploded view. Assembly 40 includes a generally rigid front cover 42 (FIG. 14) of the type used in the manufacture of mass produced hardcover books. The spine/cover assembly 40 includes a cloth layer 50 which includes a cover section 50A that covers front surface of cover 42. Cloth layer 50 further includes spine section 50B which, as will be described, will be folded around the spine of the book and over a portion of the rear book cover. The cover and spine sections of the cloth layer 50 are separated by a fold line 51D.

Spine section 50B supports an adhesive matrix 46 which includes a central adhesive band 46A and an outer adhesive band 46B, with both bands extending down the length of the spine section. Outer band 46B, which provides a function similar to adhesive. band 18C of the first embodiment, has the same length as front cover 42. As previously noted, an adhesive sold under the designation HB HL-1777 by the H. B. Fuller Company of St Paul, Minn. has been found suitable for this purpose. Central band 46A, which provides a function similar to that of central band 18B of the first embodiment, is somewhat shorter than the length of front cover 42 so that there will be a gap or space between each end of band 46A. These gaps, as was the case for similar gaps present on the first embodiment adhesive matrix, permits the low viscosity molten adhesive of band 46A to flow a short distance without being visible after the binding process is completed. Band 46A, like band 18B, is a low viscosity, heat-activated adhesive. Again, an adhesive made by National Starch & Chemical Company of Bridgewater, N.J. under the designation Cool-Bind 34-1301 has been found suitable for inner band 46A. It is also preferable that a thin layer. (not depicted)-, typically 0.003 inches, of high viscosity adhesive being applied to the entire surface of the spine section 50B before application of the remaining adhesives of the matrix.

As was the case for the first embodiment, central band 46A should be at least as wide as the thickness of the stack to be bound. Typically, band 46A will be wider than the stack thickness depending upon the actual stack dimension. Further, the edge of central adhesive band 46A facing. the front cover 42 should be spaced slightly away from fold line 51D to accommodate the thickness of the front cover 42 so that, when the front cover is rotated along line 51D until the cover is perpendicular to the spine section as shown in FIG. 16, the edge of band 46A will abut the edge of the front cover 42. This will ensure that the top sheets of the stack to be bound, those closest to the front cover, will contact the molten adhesive of central band 46A during binding.

Cloth layer 50 is dimensioned so that the layer can fully cover the outer surface of the rigid front cover 42 and so that there is sufficient material to permit the cloth-layer to be folded around all edges of the cover 42 except edge 42A. The cloth layer 50 will be of sufficient width so that the layer will extend past fold line 51D, the point at which the layer will intercept edge 42A, a sufficient distance to edge 55 to form the spine section 50B of the desired width. As was the case of the first embodiment binding system, the second embodiment system is preferably produced in four different sizes (spine section widths) to accommodate the various stack thicknesses as set forth in Table 1, above.

The cloth layer 50 is attached to the front cover 42 using an adhesive which is applied both to the entire outer surface of the cover and to the margins of the inner surface of the cover. Cloth layer 50 is preferably a material commonly referred to as book cloth, with such material having a thin backing, such as paper, which acts as a barrier and prevents the adhesive which secures the layer 50 to the cover from saturating the cloth and thereby detracting from the appearance of the bound book.

Cloth layer 50 is folded around the margins of three edges of the front cover 42 at fold lines 51A, 51B and 51C. Cloth layer 50 is also folded over itself on line 51A and line 51C at the spine section 50B (between edge 55 and fold line 51D). The folded layers are glued together to form a single layer having a thickness equal to twice that of the cloth layers. The adhesive matrix 46 is disposed on the spine section 50B, over the two folded cloth layers at the two ends of the spine section.

A paper end sheet 52, folded in half at line 53 to form a cover section 52A and a fly leaf section 52B, is secured to the inner surface of the cover section 42 using an adhesive. The cover section and fly leaf section preferably both have the same length and width of the stack to be bound. The adhesive is applied to the inner surface of the cover section 52A, with the cover section 52A being positioned to cover all of the exposed edges of the cloth layer that are folded over the edges of the front cover 42. The fold line 53 of the end sheet 52 is positioned along the fold line 51D of the cloth layer. As can best be seen in FIG. 16, the cover section of 52A of the folded end sheet 52 covers the exposed periphery of the folded edges of the cloth layer 50 thereby enhancing the appearance of the bound book. Typically, rigid front cover 42 will be somewhat larger in terms of width and length than the stack to be bound. Since the cover section 52A of end sheet 52 is the same size as the stack, there will be an exposed cloth border on the inside of the cover, similar to that of a conventionally bound hardcover book.

A narrow adhesive strip 48B is disposed on the fly leaf section 52B, along fold line 53. Strip 48B is positioned close to fold line 53, with the distance between the strip 48B and fold line 53 depicted in FIG. 14 being exaggerated for purposes of clarity, as is the thickness of the adhesive strip itself. Strip 48A is preferably made of the same adhesive as used in the central adhesive band. The strip is made thin so that the strip is more easily melted during binding, with the strip typically being 1/32 to 1/8 inches wide and 0.002 to 0.010 inches thick. As will be explained, the adhesive strip 48A operates to bond the lower edge of the fly leaf. section 52B to the lower edge of the top sheet of the stack to be bound. By securing the edge of the fly leaf section to the stack in this manner, the underlying adhesive of the adhesive matrix 46 concealed when the bound book is opened. This feature further enhances the appearance of the bound book. As will be explained later, an indentation is preferably formed in the outer surface of the front cover along fold line 51D. The cloth layer conforms to the indentation so as to further simulate the appearance of a hardback book bound using conventional techniques.

Figure 17:
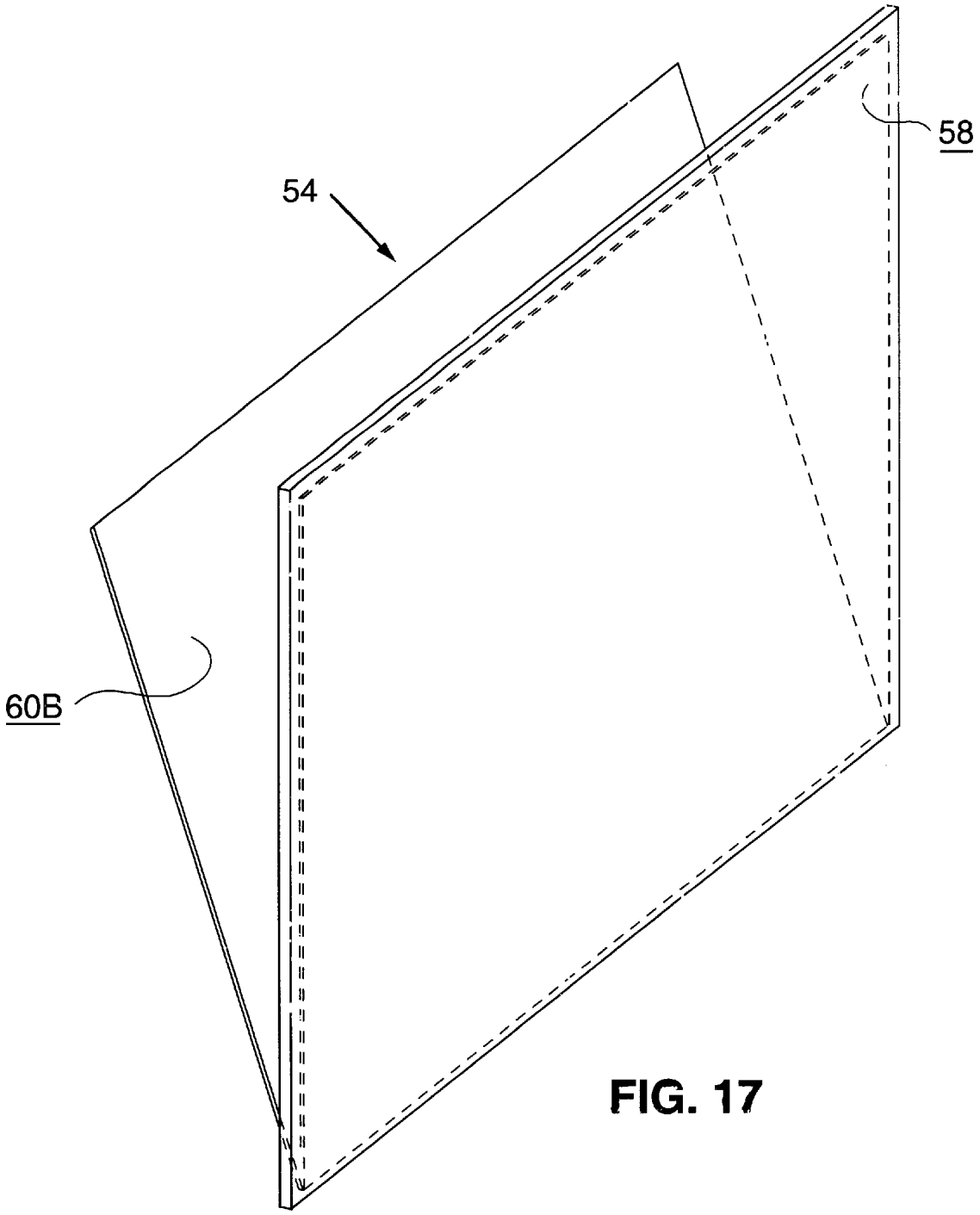
FIG. 17 is a perspective view of the rear cover assembly of the second embodiment of the present invention.

The back cover assembly 54 is shown in FIGS. 15 and 17. The assembly includes a rigid rear cover 56 having the same dimensions as the rigid front cover 42. The outer surface of the rear cover 56 is covered by a cloth layer 58 which matches cloth layer 50 of the front cover. Cloth layer 58 is larger that cover 56 so that the edges of the cloth layer can be folded around the four edges of cover 56 at fold lines 58A, 58B, 58C and 58D. An end sheet 60, identical to end sheet 52 of the front cover, includes a cover section 60A and a fly leaf section 60B. The cover section 60A is secured to the inside of the rear cover by way of an adhesive. The fold line 61 of the end sheet is disposed at edge 56A of the rigid cover. Thus, a cloth border is produced at three edges of the rigid cover to simulate the appearance of a conventionally bound book.

A thin adhesive strip 48B, similar to strip 48A, is positioned on the fly leaf section 60B, along the fold line 61 of end sheet. During the binding sequence, the adhesive strip 48B will become molten and will form a bond between the fly leaf section 60B and the last sheet of the stack. Again, this feature conceals the underlying adhesive of matrix 46 thereby enhancing the appearance of the book.

The process of binding a stack using the second embodiment system is similar to the process previously described in connection with the first embodiment. A cover spine assembly 40 having a spine section 44 of a width appropriate for the width of the stack to be bound is first selected in accordance with Table 1. As was the case with the first embodiment, the spine section 50B should be wider that the thickness of the stack to be bound so that the spine section can be wrapped around the edge of the stack, with the edge of every sheet of the stack being positioned opposite some portion of the central adhesive band 46A. Further, the spine section width must be such that outer adhesive band 46B will be fully engaged by rotating section 32B of the heated platen as shown in FIG. 10. If the spine section 50B is too wide, the adhesive band 46B will be positioned too high on the back cover assembly 54 to be engaged by rotating section 32B. If the spine section is too narrow, it is likely that last sheets of the stack to be bound will not be positioned over the central adhesive band 46A so that the sheets will not be adequately secured.

One the appropriate cover/spine assembly 40 has been selected, the back cover assembly 54 is positioned over the last page of the stack to be bound. Next, the stack and back cover assembly are placed over the cover/spine assembly 40. The spine section 50B is then folded under the edge of the stack, along fold line 51D, similar to the configuration shown in FIGS. 5 and 6. The arrangement is then inserted into a conventional desktop binding machine, with the sequence shown in FIGS. 7A, 7B, 8, 9, 10 and 11 being carried out automatically. As represented by FIG. 10, the outer portion of the spine section 50B, including side adhesive band 46B, will be forced against the lower portion of the back cover assembly 54. The side adhesive 46B will form a bond between the cloth layer 58 on the rear cover and the cloth layer of spine section 50B. The edge of the spine section cloth layer will remain exposed but will not be readily apparent assuming that the compressed adhesive has been transferred up to but not past, the edge. The heat from the binding sequence will operate to activate the two adhesive strips 48A and 48B so that the first and last sheets of the stack will be secured to the front and rear fly leaf sections 52B and 60B, respectively. Adhesives 46A and 46B will be activated in a manner similar to that of the first embodiment adhesives 18B and 18C and will perform substantially the same functions.

Figure 18:
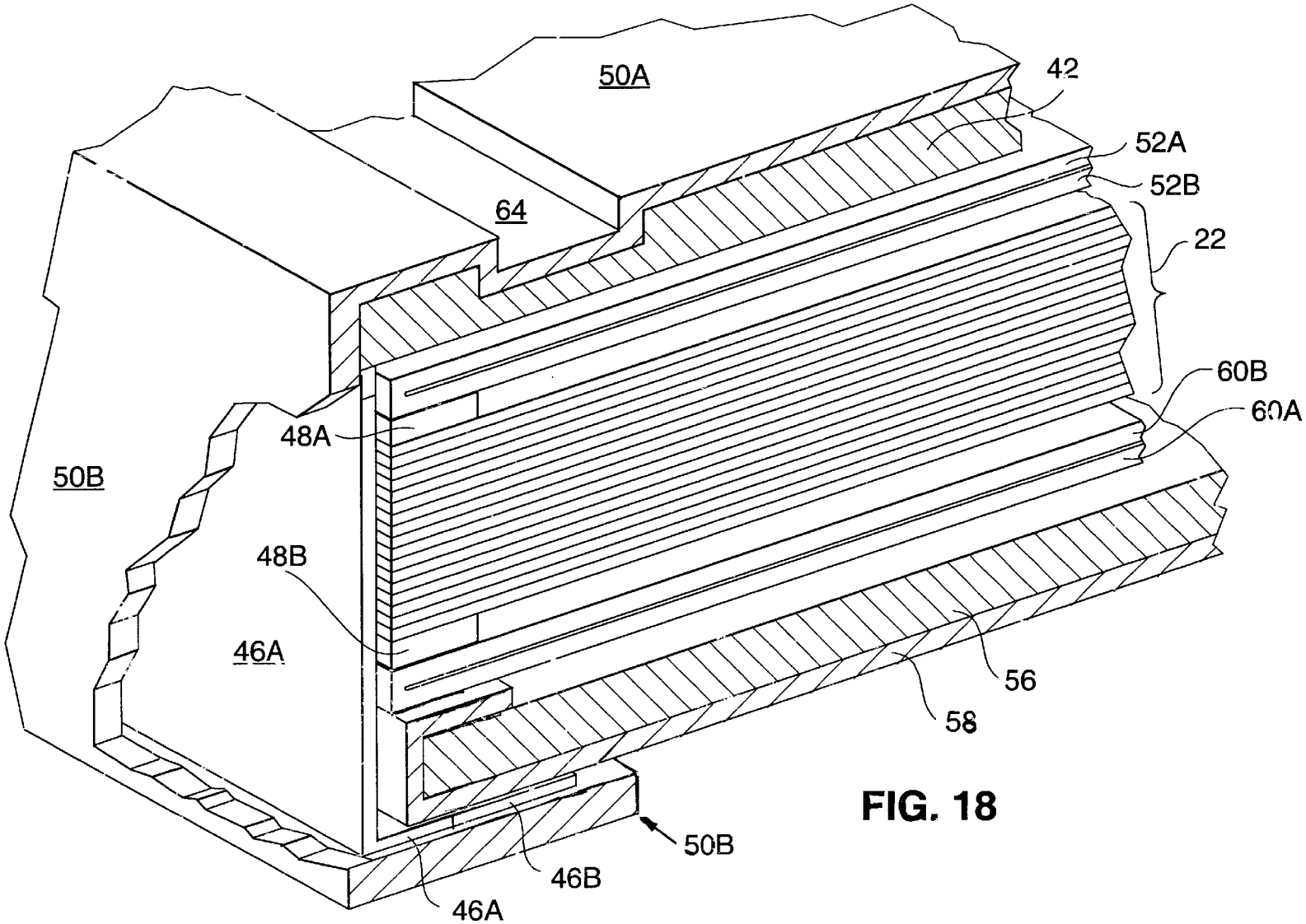
FIG. 18 is a perspective, cross-sectional view of the spine of a book bound in accordance with the second embodiment of the present invention.
Figure 19:
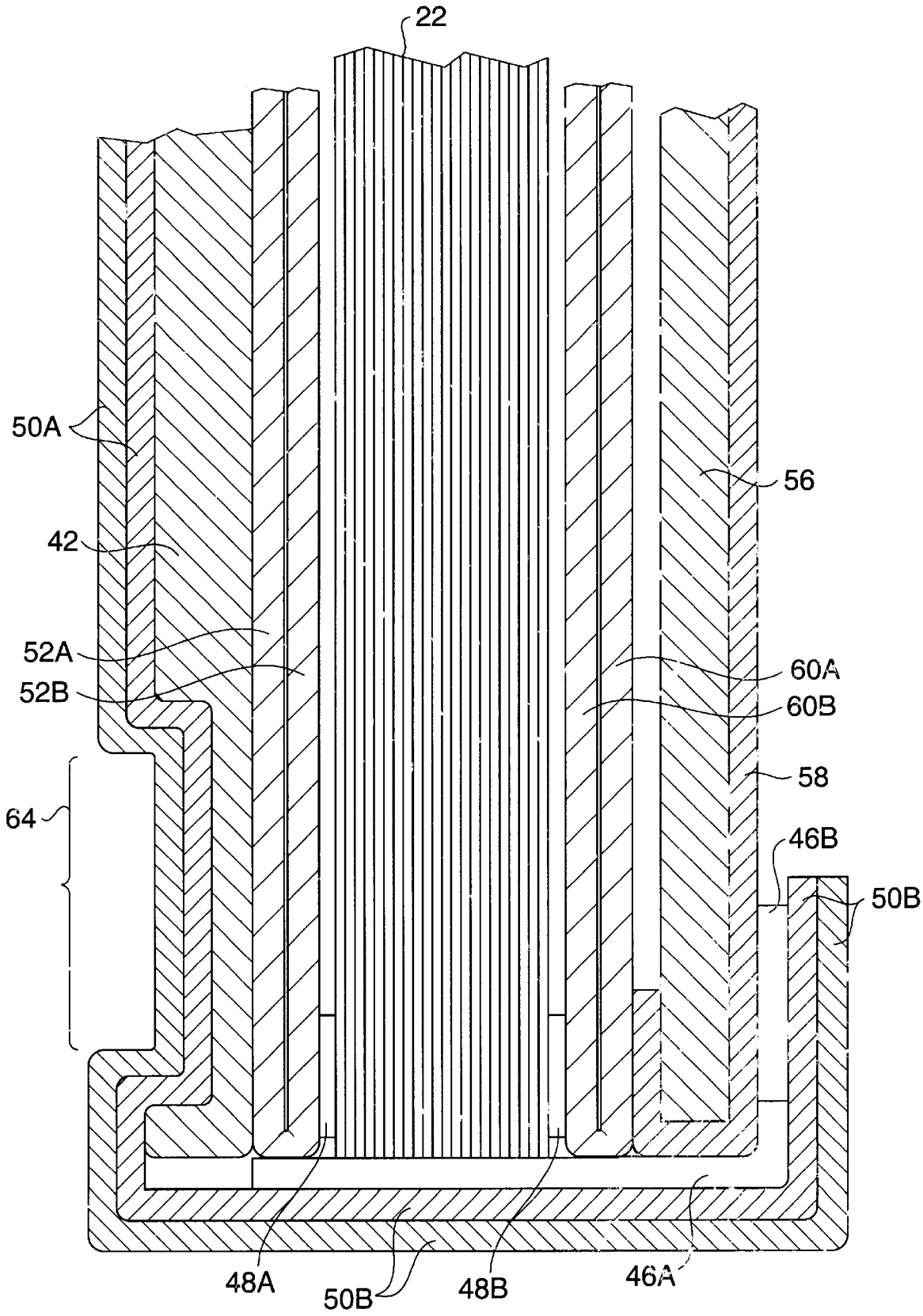
FIG. 19 is a fragmentary end view of the spine of a book bound in accordance with the second embodiment of the present invention.

FIG. 18 is perspective cross-sectional view of the spine portion of the final bound book using the second embodiment binding system. FIG. 19 is a fragmentary end view of the same book, with part of the spine section 50B cut away. The previously noted indentation 64 for simulating the appearance of a hardcover book bound using conventional techniques is shown in both figures. The views are not to scale, with certain dimensions being exaggerated for purposes of clarity. By way of example, FIG. 19 shows adhesive 46B, after the binding process, securing the two layers 50B/50B of cloth of the spine section to the cloth layer 58 of the back cover assembly 54. Adhesive layer 46B, after binding, will be relatively thin, as will be to two layer of cloth 50B/50B so that the terminal edge of the spine section cloth on the rear cover cloth 58 will be much less discernable than depicted.

Figure 20:
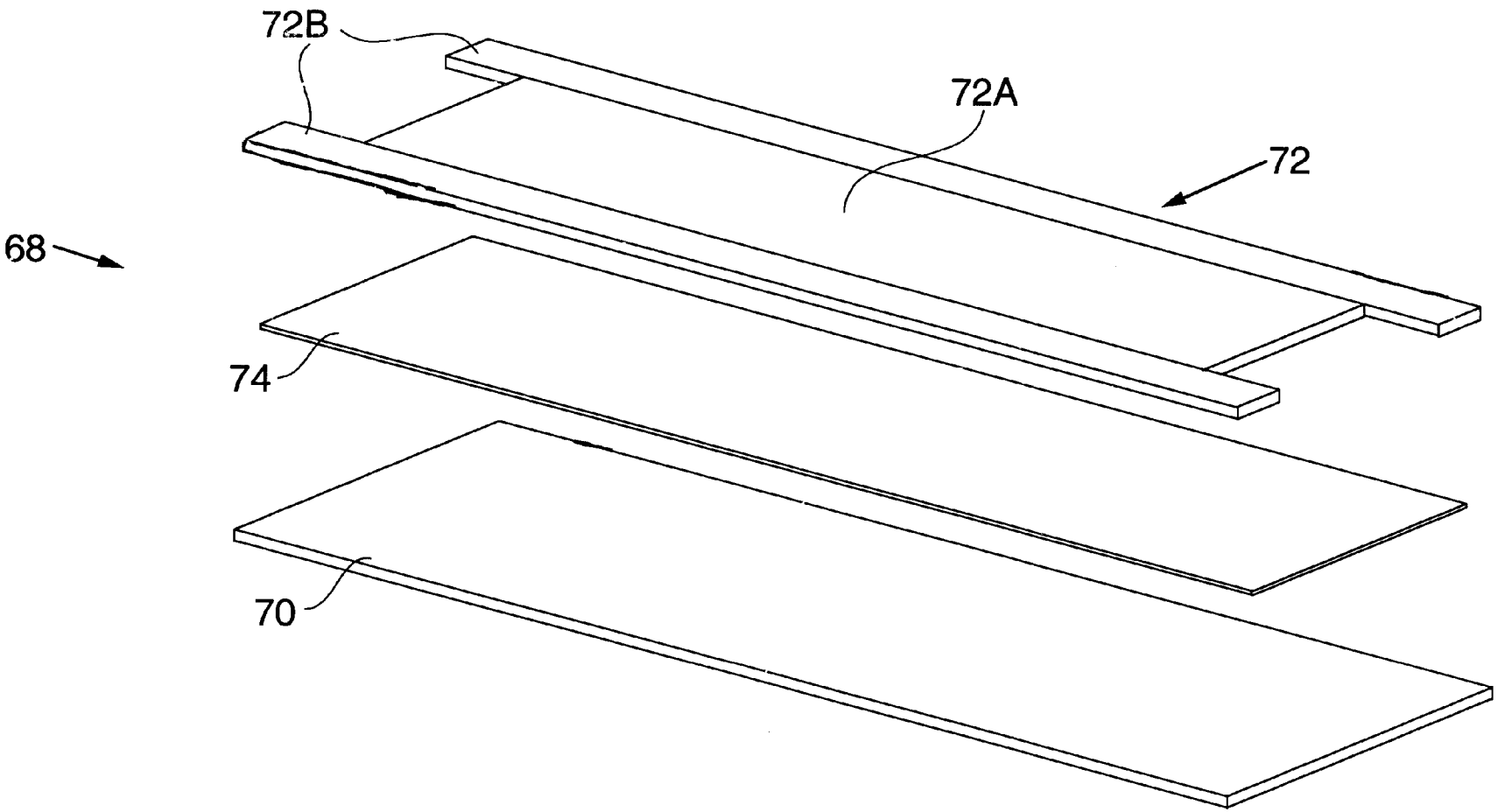
FIG. 20 (PRIOR ART)
FIG. 20 is an exploded view of a conventional binder strip.

A third embodiment bookbinding system will now be described. First, a conventional binder strip, the construction of which is depicted in FIG. 20, is used to bind the stack of sheets 22 which are to be part of the final bound book. As will be explained, the binder strip 68 will subsequently be removed from the stack 22, leaving a bound structure suitable for adding either a soft or a hard cover.

The binder strip 68 includes an elongated substrate 70 having a length which corresponds to the length of the stack and a width the exceeds the thickness of the stack by at least a minimum amount so that the edges of the substrate 70 will extend around the edge of the stack and slightly over the front and back pages of the stack, as will be described. Substrate 70 is preferably made of a flexible plastic or a formable material such as heavy weight paper.

The binder strip is provided with a an adhesive matrix 72 which is comprised of a center adhesive 72A which extends along the longitudinal axis of the substrate 70 and a pair of outer adhesive bands 72B. The center adhesive band 72A, which is a heat activated adhesive-of relatively low viscosity, is the primary adhesive for binding the pages together. The center adhesive 72A is typically 0.015 inch thick. An adhesive, sold under the designation Cool Bind 34-1301 by National Starch & Chemical Company of Bridgewater, N.J., has been found to be suitable as the center adhesive band 72A. The center adhesive band 72A preferably extends over slightly less than the full length of the binder strip 68 so that there are end gaps without the center adhesive 72A. In addition, the center adhesive band is at least as wide as the thickness of the stack 22 to be bound so that all of the pages of the stack will be exposed to the low viscosity adhesive.

The outer adhesive bands 72B are comprised of a heat activated adhesive of relatively high viscosity when activated and possesses a high degree of tackiness. The outer adhesive bands 72B function to attach the substrate 70 to the front and back pages of the stack. The outer adhesive bands 72B preferably extend along the entire length of substrate 70 and are 0.010 inch thick. An adhesive sold under the designation HB HL-1777 by H. B. Fuller Company of St. Paul, Minn., may be used for the outer adhesive bands 4B.

The FIG. 20 binder strip 68 further includes an undercoat adhesive layer 74 disposed intermediate the adhesive matrix 72 and the substrate 70. The undercoat adhesive is heat activated and is relatively thin, typically 0.003 inches thick. The undercoat is preferably the same type of adhesive used in the outer adhesive bands 72B and functions to act as a barrier so as to prevent the low viscosity central adhesive band 72A from passing through the substrate 70. In addition, the undercoat adhesive prevents all of the low viscosity adhesive of central band 4A from being drawn up between the pages of the stack which may leave essentially no adhesive intermediate the edges of the pages and the substrate 70.

The manner in which the binders strip 68 is applied to the stack 22 and used to bind the stack will be subsequently described. However, the first and last sheet of the stack are sacrificial sheets which are discarded during the binding sequence. Accordingly, these sacrificial sheets must be added to the sheets that are to be bound.

Figure 21:
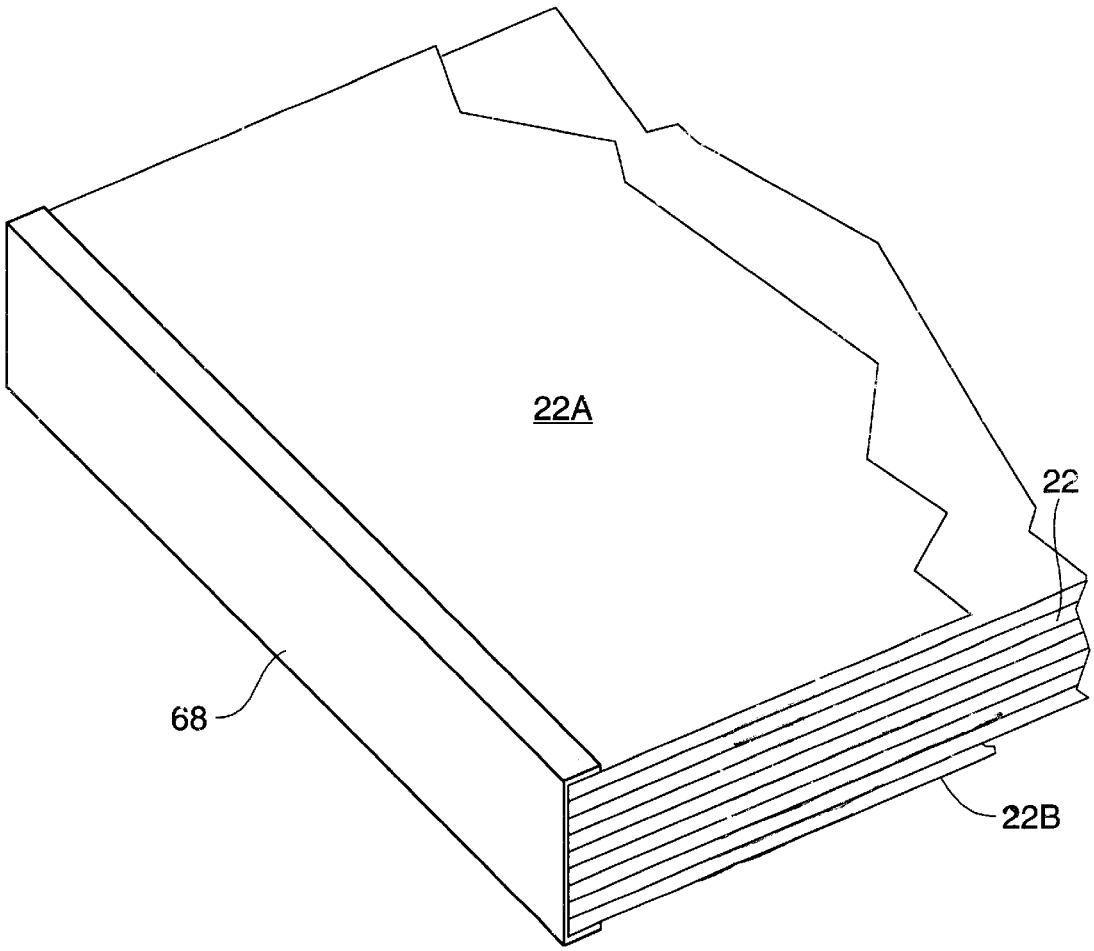
FIG. 21 is a perspective view of a stack of sheets bound with the FIG. 20 binder strip.
Figure 22:
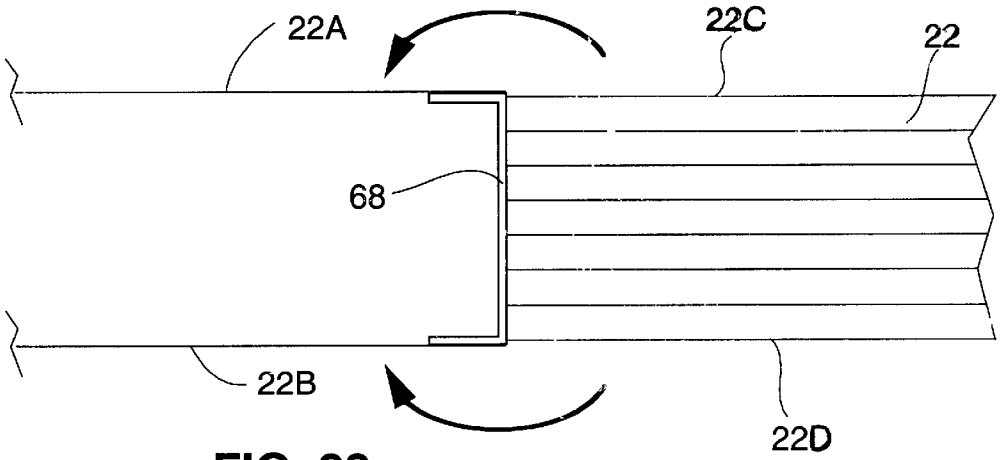
FIG. 22 illustrates the manner in which a binder strip substrate is removed from a bound stack.
Figure 23:
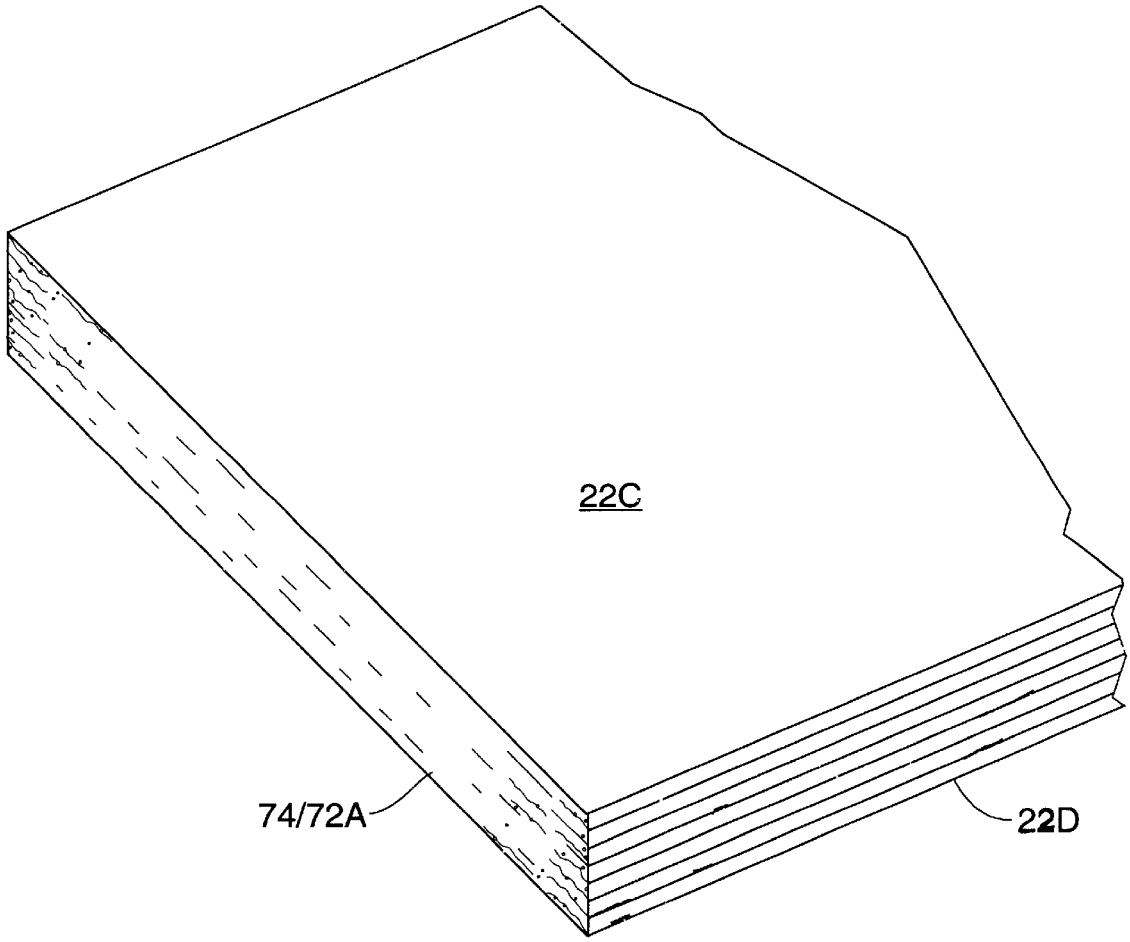
FIG. 23 shows a bound stack after the binder strip substrate has been removed.

Once the stack of sheets 22 has been bound with the binder strip 68, the resultant structure is shown in FIG. 21. As previously noted, much of the center adhesive 72A (FIG. 20) is drawn up between the individual sheets, with the remaining portion of the adhesive remaining between the edge of the stack 22 and the substrate 70. A user next removes substrate 70 from the stack together with the front and back sacrificial sheets 22A and 22B. This may be accomplished by first folding the sacrificial sheets 180 degrees as shown in FIG. 22. This exposes the underlying sheets 22C and 22D which will be the first and last sheets in the final bound book, exluding any fly sheets. The user then grips the stack 22 in one hand and sheets 22A and 22B in the other hand and pulls the binder strip 68 and sacrificial sheets away from the stack. The resultant structure is shown in FIG. 23. The stack remains bound together by remaining adhesive 72A, with adhesive 74 also possibly remaining.

Figure 26A:
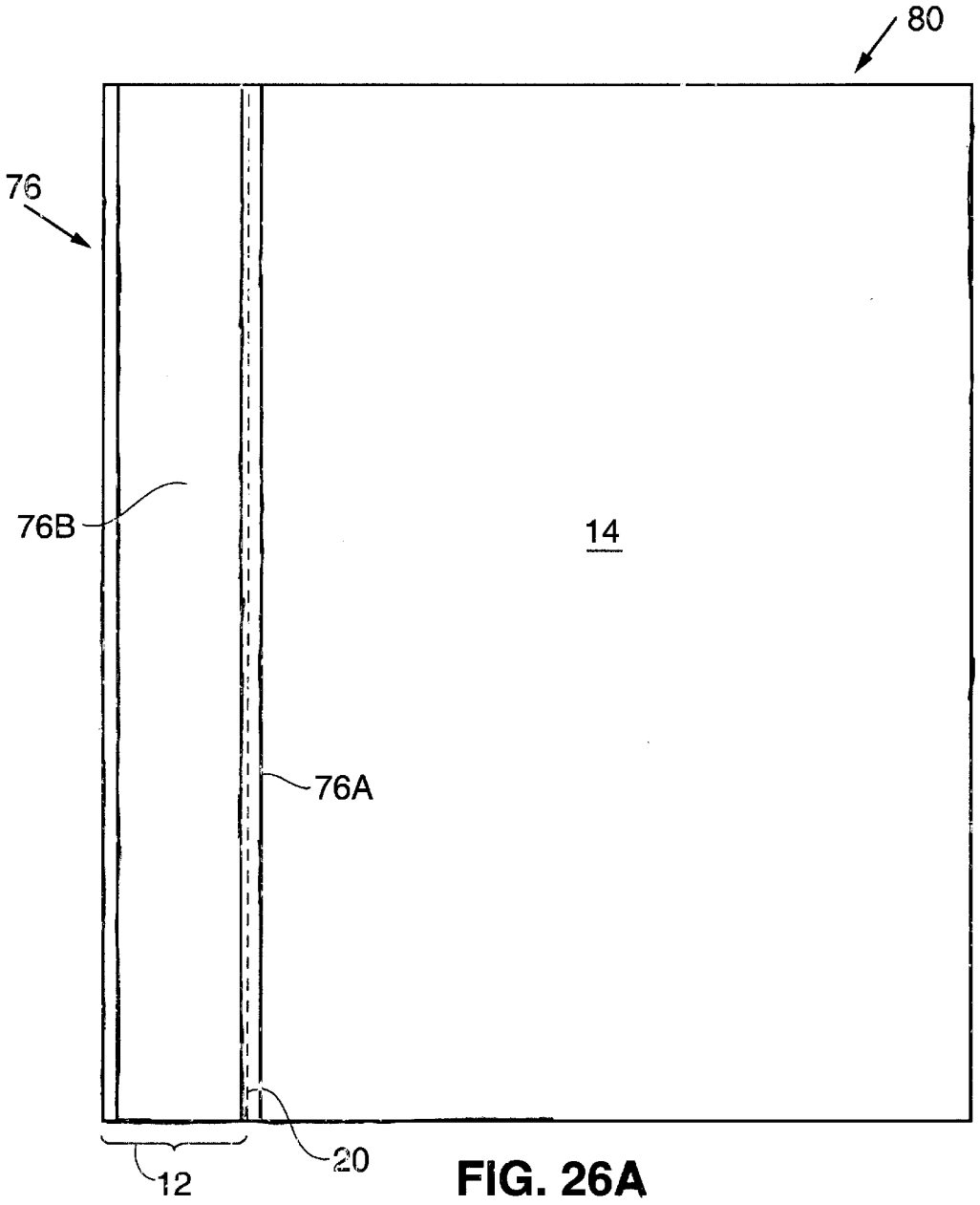
FIGS. 26A and 26B show an alternative embodiment of the FIGS. 1 and 2 cover/spine assembly.
Figure 26B:
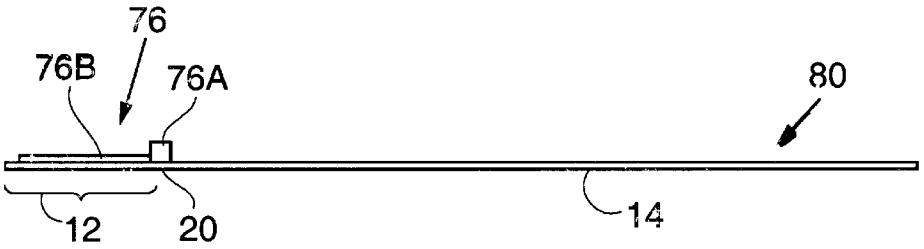

FIGS. 26A and 26B show an alternative cover/spine assembly 80 similar in construction to the FIG. 1 assmembly with the exception of the adhesive matrix 18 of the FIG. 1 cover/spine assembly. The adhesive matrix 76 of the FIG. 26A/26B embodiment does not include a central adhesive band 18B of low viscosity adhesive. The function of the low viscosity adhesive 18B is carried out by the adhesive remaining in the FIG. 23 structure from the binder strip 68. Instead, a relatively thin layer of high tack adhesive, similar to the type of adhesive used in band 18C of the FIG. 1 embodiment is used which extends substantially over all of the spine section 12 of the assembly.

The FIGS. 26A/26B cover spine assembly 80 is next applied to the bound stack of sheets 22, together with the rear cover piece 16 of FIG. 3, in substantially the same manner as previously described in connection with the FIG. 1 embodiment. The sequence is shown in FIGS. 5–10 where the stack 22 is again inserted in a conventional binding machine. This causes the cover spine assembly to be 80 to be secured to the stack, primarily by way of adhesive 76B of the assembly.

The manner in which the conventional binder strip 68 is applied to stack 22 will now be described. One significant advantage of the present invention is that an existing, commercially available binding machine, such as machine 118 of FIG. 24, can be used to carry out the binding sequence. One such machine is described in U.S. Pat. No. 5,052,873, the contents of which are hereby fully incorporated herein by reference. The binding sequence set forth in U.S. Pat. No. 5,052,873 uses a conventional binder strip of the type disclosed in previously noted U.S. Pat. No. 4,496,617.

Figure 24:
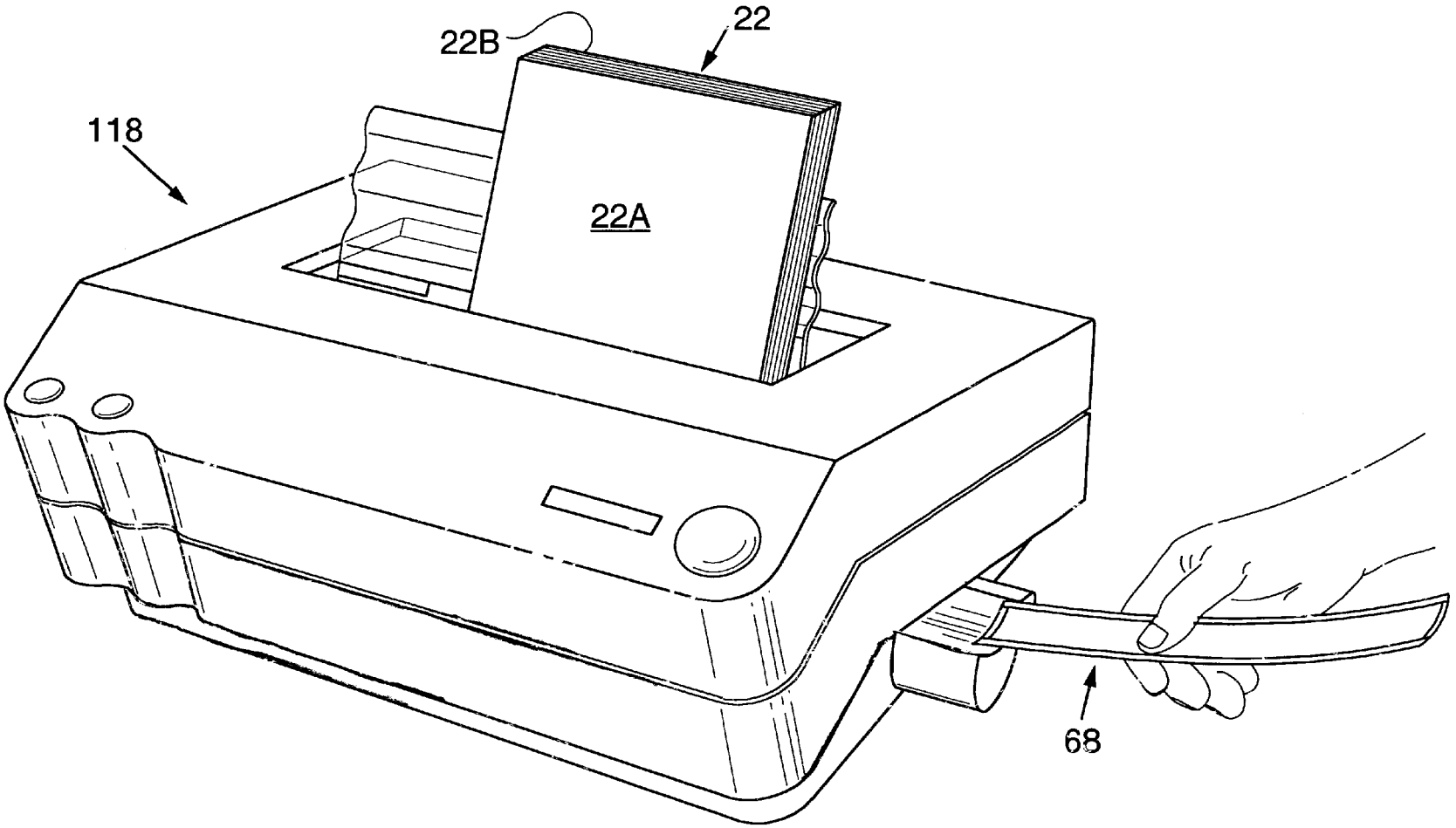
FIG. 24 (PRIOR ART)
FIG. 24 shows a conventional binding machine.

The conventional binding machine 118 shown in FIG. 24 is described in U.S. Pat. No. 5,052,873. Machine 118 has the stack 22 to be bound inserted into the machine input. The thickness of the stack is automatically measured and the appropriate width binding structure 68 is displayed. As is the case with conventional binder strips, the binding structure 68 is preferably available in three widths to accommodate stacks 22 of varying width. Such widths include "Narrow", "Medium" and "Wide", with the width of the central adhesive band 4A being altered for each binder structure 68 width. Machine 118 will specify a structure 68 width having a central adhesive 72A width that is at least as wide as the measured thickness of the stack 22. A binding strip 68 of the appropriate width is then manually fed into the strip feed input of the machine 118. The machine then automatically carries out the binding sequence by appropriately positioning the strip 68 relative to the edge of the stack 22 and applying a combination of heat and pressure as will be described.

Figure 25A:
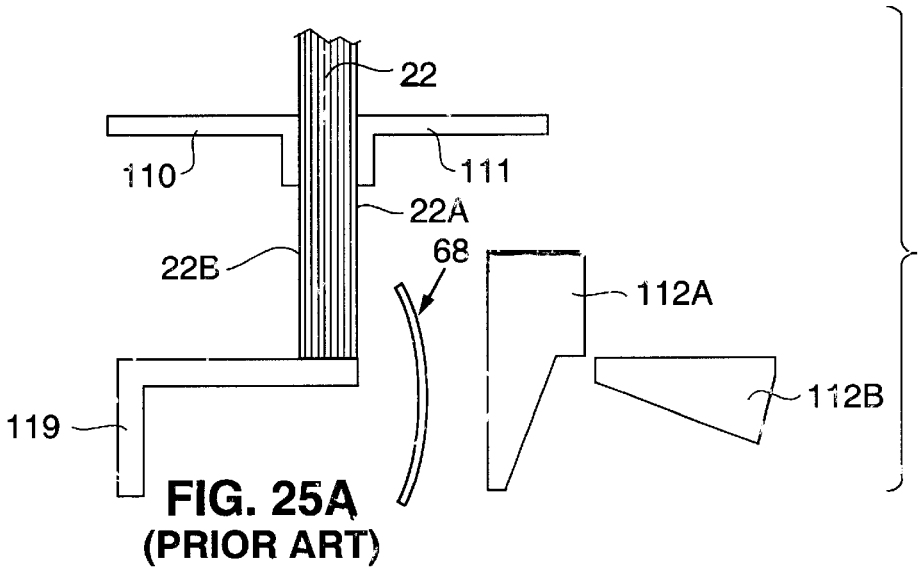
FIG. 25A (PRIOR ART)
FIGS. 25A–25E schematically illustrate the manner in which the conventional binder machine binds a stack of sheets using a binder strip.

The binding sequence is depicted schematically in FIGS. 25A through 25E. End views are shown of the stack 22 and the binder strip 68. Referring to FIG. 25A, the stack 22 to be bound, after loading, is gripped between a pair of clamps 110 and 111 and is initially supported on a cool platen 119. A strip positioning apparatus (not depicted) positions the binder strip 68 previously fed into the machine so that the adhesive matrix 72 is facing the stack 22. The vertical position of the strip 68 relative to the stack 22 is automatically set in accordance with the thickness of the stack as previously measured. A thin stack 22 will result in the strip 68 being positioned relatively high so that the edges of the strip will extend equally over the front and rear sacrificial sheets 22A and 22B of the stack. Similarly, a thick stack will result in the strip 68 being positioned somewhat lower. A heated platen having a rotating segment 112A and a non-rotating segment 112B is positioned facing the binder strip 68. The platen segments 112A and 112B are at least as long as the length of the stack and the length of the elongated binder strip 68.

Figure 25B:
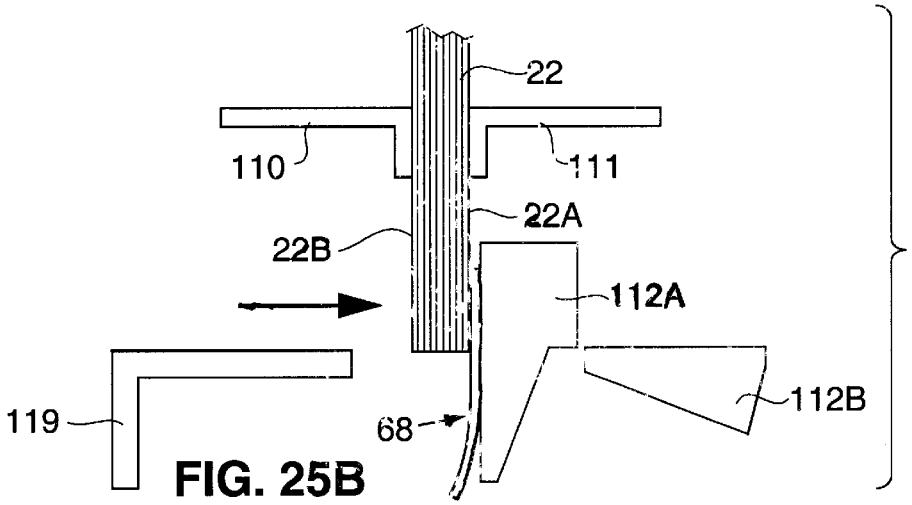
FIG. 25B (PRIOR ART)
Figure 25C:
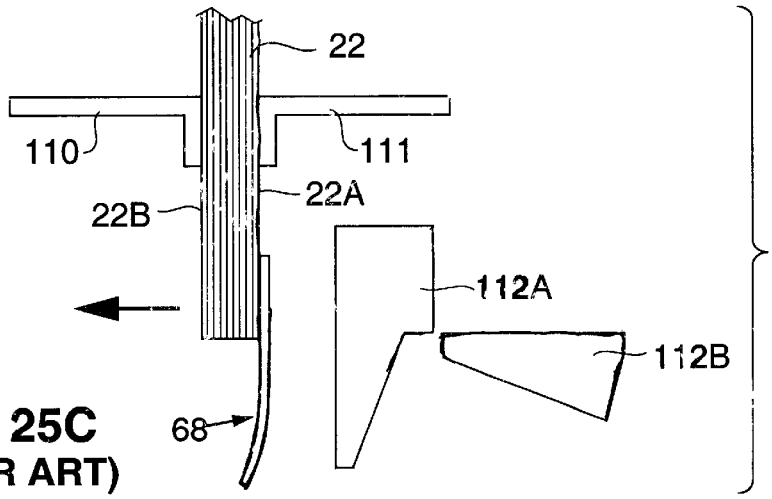
FIG. 25C (PRIOR ART)

As shown in FIG. 25B, the stack 22 is moved laterally away from:the cold platen 119 towards the rotating platen segment 112A. This movement is carried out by way of clamps 110 and 111 which support and move the stack. The lower portion of the stack 22 is forced against the heated rotating platen portion 112A, with one edge of the binder strip 68 being disposed between the platen portion 112A and the stack 22. Note that the binding machine element which supports the opposite side of stack 22 at this point in the sequence is not depicted in the drawings. The resultant heat and pressure applied to one edge of the binder strip 68 results in activation of one of the outer adhesive bands 72B (FIG. 20). This will cause an adhesive bond or seal to be formed between the strip 68 and the front page 22A of stack 22. Since the outer adhesive bands 72B are high tack when activated, the strip 68 remains bonded to the front page 22A of the stack 22 when the stack is moved away from the heated rotating platen portion 112A as shown in FIG. 25C.

Figure 25D:
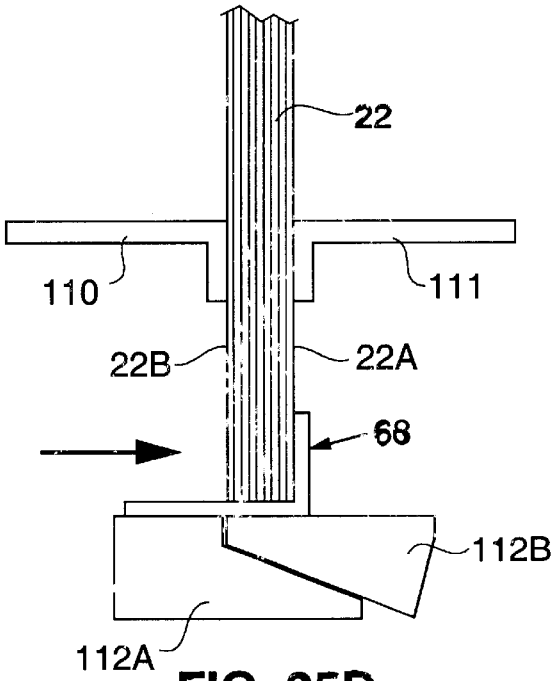
FIG. 25D (PRIOR ART)
Figure 25E:
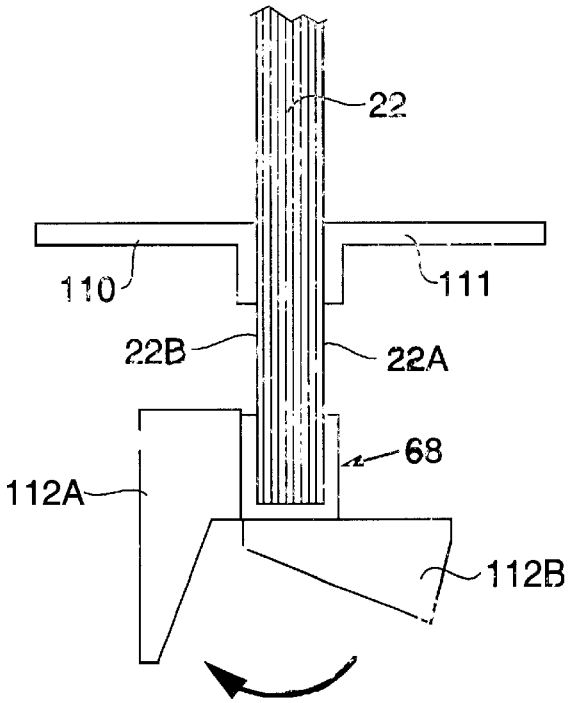
FIG. 25E (PRIOR ART)

As shown in FIG. 25D, the rotating platen segment 112A is rotated 90 degrees so that both the rotating and fixed platen segments 112A and 112B define a flat upper surface. This permits stack 22 to be moved to the right over the platen segments. This causes the binder strip 68 to be folded around the lower edge of the stack 22. The binding machine 118 pauses briefly in this position so that the central adhesive band 72A will have time to become molten and to flow upward by way of capillary action between the individual pages of the stack 22 thereby fulling wetting the pages with the adhesive. The rotating platen segment 112A is then rotated 90 degrees back to the original position as shown in FIG. 25E. This results in the remaining edge of the binder strip 68 to be folded around the edge of the stack 22, with the remaining outer adhesive band 72B being positioned facing the rear page 22B of the stack 22. The stack 22 is then forced against the rotating platen portion 112A thereby activating the outer adhesive band 72B so as to form the final adhesive bond. The bound stack 22 is then removed from the binding machine and permitted to cool for a few minutes so that the adhesives have an opportunity to set. The binder strip is then removed as described in connection with FIG. 22 so that the remainder of the sequence can be carried out.

Figure 27:
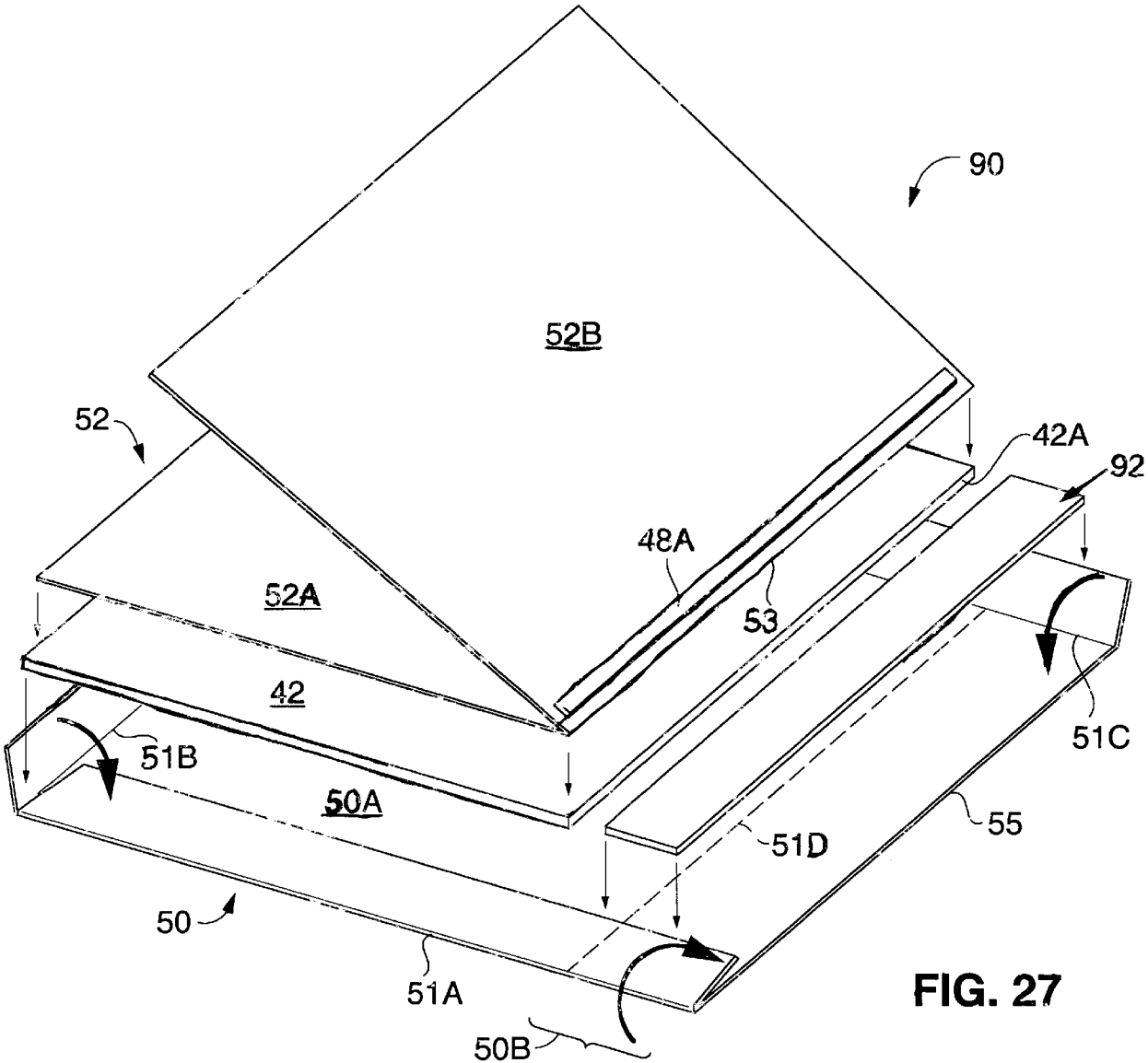
FIG. 27 shows an alternative embodiment of the FIG. 14 cover/spine assembly.

FIG. 27 shows an alternative embodiment of the FIG. 14 spine cover assembly 40. The FIG. 27 assembly 90 is the same as shown in FIG. 14 with the exception of the adhesive matrix 46 used in assembly 40. A uniform layer 92 of high tack, high viscosity adhesive is disposed over the spine section, with an adhesive similar to outer adhesive bands 72B being preferred. Again, the low viscosity adhesive 46A is not needed since the function carried out by adhesive 46A is now performed by the remaining adhesive 72A remaining on the stack 22 as shown in FIG. 23. The cover/spine assembly 90 is then combined with the FIG. 23 stack 22 and the back cover assembly 54 in the same manner as previously described in connection with FIGS. 7–10.

Thus, novel bookbinding structures and method have been disclosed. Although various embodiments have been described in some detail, it is to be understood that various changes can be made by those skilled in the art without departing from the spirit and scope of the invention as defined by the appended claims. By way of example, cloth layer 50 could be replaced with a paper layer if desired. In addition, fly leaf sections 52B and 60B can be replaced with fan-folded fly leaf sections. In that event, the fly leaf sections, prior to folding, have the same length but have a larger width than the stack. The front and back fly leaf sections are each folded over on itself multiple times so that each folded fly leaf section has the same length and width as the stack. Typically, a first fold is formed at the same location and in the same direction as fold line 61 of the back cover end sheet 60 (or fold line 53 of the front cover end sheet 52). A second fold is formed at a location at perhaps half the width of the stack away from fold line 61 and in a direction opposite the first fold line so that the fly leaf section then overlies the first fold line. Finally, a third fold is formed along a line which overlies fold line 61 and which is in the same direction as the first fold line and which terminates at the opposite edge of the stack as the same location that the original fly leaf section terminated. This produces a fan-folded fly leaf section, with adhesives 48A and 48B being disposed on the fly leaf sections so as to engage the first and last sheets of the stack in the same location as the original fly leaf sections.

What is claimed is:

1. A method of binding a stack of sheets comprising:

positioning a binder strip having a heat activated adhesive supported on a substrate to an edge of the stack;

applying heat to the binder strip so that the binder strip is secured to the stack;

separating the substrate from the stack;

subsequent to the separating, positioning a cover assembly having an heat activated adhesive to the stack; and applying heat to the cover assembly so that the cover assembly is secured to the stack.

2. The method of claim 1 wherein the stack of sheets further includes at least one upper sacrificial sheet on a top of the stack and at least one lower sacrificial sheet on a bottom of the stack and wherein the separating includes separating, together with the substrate, the at least one upper sacrificial sheet and the at least one lower sacrificial sheet from the stack.

3. The method of claim 1 wherein the heat-activated adhesive on the cover assembly is a relatively high tack adhesive when activated.

4. The method of claim 2 wherein the separating includes manually gripping the at least one upper sacrificial sheet and the at least one lower sacrificial sheet and pulling the sacrificial sheets and substrate away from the stack of sheets.

5. A method of binding a stack of sheets comprising:

providing a substrate having a heat activated adhesive disposed on one surface;

transferring the heat activated adhesive from the substrate to an edge of the stack so that the heat activated adhesive is present on the edge of the stack and so that the sheets are bound together by the heat activated adhesive, wherein the transferring includes applying the substrate to the edge of the stack, heating the substrate, cooling the adhesive of the substrate so that the substrate adhesive is attached to the stack, and then separating the substrate from the stack;

positioning a cover assembly around the edge of the stack; and applying heat through the cover assembly so as to secure the cover assembly to the stack.

6. The method of claim 5 wherein the adhesive transferred to the edge of the stack includes a relatively low viscosity adhesive which functions to bind the sheets of the stack together.

7. The method of claim 5 further including positioning a sacrificial layer on the top of the stack and a sacrificial layer on the bottom of the stack prior to the transferring and further including separating the top and bottom sacrificial layers from the stack prior to the positioning of the cover assembly around the edge of the stack.

8. The method of claim 6 wherein the cover assembly, prior to the positioning, includes a heat activated adhesive.

9. The method of claim 8 wherein the cover assembly heat activated adhesive is a relatively high viscosity adhesive.

10. The method of claim 9 wherein the cover assembly heat activated adhesive is a relatively high tack adhesive.

11. The method of claim 7 wherein the top and bottom sacrificial layers include additional ones of the sheets of the stack.

* * * * *